US008075099B2

(12) United States Patent
Sheahan et al.

(10) Patent No.: US 8,075,099 B2
(45) **Date of Patent: *Dec. 13, 2011**

(54) PRINTER WITH CONTROLLER FOR GENERATING COMBINED PRINT DATA AND CLOCK SIGNAL

(75) Inventors: John Robert Sheahan, Balmain (AU); Mark Jackson Pulver, Balmain (AU); Brian Christopher Morahan, Balmain (AU); Alireza Moini, Balmain (AU); Timothy Peter Gillespie, Balmain (AU); Michael John Webb, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 0 days.

This patent is subject to a terminal disclaimer.

(21) Appl. No.: 12/778,090

(22) Filed: May 11, 2010

(65) Prior Publication Data

US 2010/0220136 A1 Sep. 2, 2010

Related U.S. Application Data

(63) Continuation of application No. 11/544,769, filed on Oct. 10, 2006, now Pat. No. 7,722,163.

(51) Int. Cl.
*B41J 2/04* (2006.01)

(52) U.S. Cl. ..... 347/54; 347/58; 347/14; 347/17

(58) Field of Classification Search ..... 347/14, 347/17, 19, 20, 40, 44, 47, 49, 50, 54, 56–59
See application file for complete search history.

(56) References Cited

U.S. PATENT DOCUMENTS

| | | | |
|---|---|---|---|
| 5,760,796 | A | 6/1998 | Hayasaki et al. |
| 5,760,797 | A | 6/1998 | Koizumi et al. |
| 5,774,137 | A | 6/1998 | Yoshida |
| 6,062,666 | A | 5/2000 | Omata et al. |
| 6,102,510 | A | 8/2000 | Kikuta et al. |
| 6,120,125 | A | 9/2000 | Kim |
| 6,227,641 | B1 | 5/2001 | Nishikori et al. |
| 6,280,012 | B1 | 8/2001 | Schloeman et al. |
| 6,305,776 | B1 | 10/2001 | Ohshima et al. |
| 6,315,388 | B1 | 11/2001 | Goh |
| 6,375,295 | B1 | 4/2002 | Ghozeil et al. |
| 6,375,299 | B1 | 4/2002 | Foster et al. |
| 6,457,794 | B1 | 10/2002 | Tajika et al. |
| 6,742,874 | B2 | 6/2004 | Hirayama et al. |
| 6,769,755 | B2 | 8/2004 | Mizutani et al. |
| 6,820,955 | B1 | 11/2004 | Usui |
| 7,001,007 | B2 | 2/2006 | Silverbrook |
| 7,207,642 | B2 | 4/2007 | Usui |
| 7,384,128 | B2 | 6/2008 | Sheahan et al. |
| 7,419,250 | B2 | 9/2008 | Silverbrook |
| 7,425,047 | B2 | 9/2008 | Sheahan et al. |
| 7,425,048 | B2 | 9/2008 | Sheahan et al. |
| 7,591,523 | B2 | 9/2009 | Sheahan et al. |
| 7,604,321 | B2 | 10/2009 | Sheahan et al. |

(Continued)

FOREIGN PATENT DOCUMENTS

| | | | |
|---|---|---|---|
| EP | 0174751 | B1 | 11/1988 |

(Continued)

*Primary Examiner* — Juanita D Stephens

(57) ABSTRACT

An inkjet printer that has a printhead IC an array of nozzles for ejecting drops of printing fluid onto a media substrate and drive circuitry for driving the array of nozzles and, a print engine controller (PEC) for sending print data to the printhead IC. The drive circuitry is configured to extract a clock signal from the data transmission from the PEC.

20 Claims, 13 Drawing Sheets

U.S. PATENT DOCUMENTS

| | | | | |
|---|---|---|---|---|
| 7,618,109 | B2 | 11/2009 | Sheahan et al. | |
| 7,658,459 | B2 | 2/2010 | Sheahan et al. | |
| 7,722,163 | B2 * | 5/2010 | Sheahan et al. | 347/54 |
| 2001/0045967 | A1 | 11/2001 | Hayasaki | |
| 2002/0036781 | A1 | 3/2002 | Hirayama | |
| 2003/0197774 | A1 | 10/2003 | Silverbrook | |
| 2003/0202085 | A1 | 10/2003 | Rother | |
| 2005/0088474 | A1 | 4/2005 | Juve et al. | |
| 2005/0134620 | A1 | 6/2005 | Hirayama et al. | |

FOREIGN PATENT DOCUMENTS

| | | | |
|---|---|---|---|
| WO | 99/08875 | A1 | 2/1999 |

* cited by examiner

PRINTER WITH CONTROLLER FOR GENERATING COMBINED PRINT DATA AND CLOCK SIGNAL

CROSS REFERENCE TO RELATED APPLICATION

The present application is a continuation of U.S. application Ser. No. 11/544,769 filed on Oct. 10, 2006, now issued U.S. Pat. No. 7,722,163, all of which are herein incorporated by reference.

FIELD OF THE INVENTION

The present invention relates to the field of inkjet printers. In particular, the invention relates to inkjet printers that have printheads with a number of separate printhead integrated circuits (IC's) defining the nozzles that eject the ink or other printing fluid.

CO-PENDING APPLICATIONS

The following applications have been filed by the Applicant simultaneously with the present application:

| | | | | |
|---|---|---|---|---|
| 7,491,911 | 11/544,764 | 11/544,765 | 11/544,772 | 11/544,774 |
| 11/544,775 | 7,425,048 | 11/544,766 | 11/544,767 | 7,384,128 |
| 7,604,321 | 7,681,970 | 7,425,047 | 7,413,288 | |

The disclosures of these co-pending applications are incorporated herein by reference.

CROSS REFERENCES TO RELATED APPLICATIONS

Various methods, systems and apparatus relating to the present invention are disclosed in the following US patents/patent applications filed by the applicant or assignee of the present invention:

| | | | | |
|---|---|---|---|---|
| 6,750,901 | 6,476,863 | 6,788,336 | 7,249,108 | 6,566,858 |
| 6,331,946 | 6,246,970 | 6,442,525 | 7,346,586 | 7,685,423 |
| 6,374,354 | 7,246,098 | 6,816,968 | 6,757,832 | 6,334,190 |
| 6,745,331 | 7,249,109 | 7,197,642 | 7,093,139 | 7,509,292 |
| 7,685,424 | 10/866,608 | 7,210,038 | 7,401,223 | 7,702,926 |
| 7,716,098 | 7,364,256 | 7,258,417 | 7,293,853 | 7,328,968 |
| 7,270,395 | 7,461,916 | 7,510,264 | 7,334,864 | 7,255,419 |
| 7,284,819 | 7,229,148 | 7,258,416 | 7,273,263 | 7,270,393 |
| 6,984,017 | 7,347,526 | 7,357,477 | 7,465,015 | 7,364,255 |
| 7,357,476 | 11/003,614 | 7,284,820 | 7,341,328 | 7,246,875 |
| 7,322,669 | 7,445,311 | 7,452,052 | 7,455,383 | 7,448,724 |
| 7,441,864 | 7,637,588 | 7,648,222 | 7,669,958 | 7,607,755 |
| 7,699,433 | 7,658,463 | 7,506,958 | 7,472,981 | 7,448,722 |
| 7,575,297 | 7,438,381 | 7,441,863 | 7,438,382 | 7,425,051 |
| 7,399,057 | 7,695,097 | 7,686,419 | 11/246,669 | 7,448,720 |
| 7,448,723 | 7,445,310 | 7,399,054 | 7,425,049 | 7,367,648 |
| 7,370,936 | 7,401,886 | 7,506,952 | 7,401,887 | 7,384,119 |
| 7,401,888 | 7,387,358 | 7,413,281 | 7,530,663 | 7,467,846 |
| 7,669,957 | 11/482,963 | 11/482,956 | 7,695,123 | 11/482,974 |
| 7,604,334 | 11/482,987 | 7,708,375 | 7,695,093 | 7,695,098 |
| 11/482,964 | 7,703,882 | 7,510,261 | 11/482,973 | 7,581,812 |
| 7,641,304 | 11/495,817 | 6,623,101 | 6,406,129 | 6,505,916 |
| 6,457,809 | 6,550,895 | 6,457,812 | 7,152,962 | 6,428,133 |
| 7,204,941 | 7,282,164 | 7,465,342 | 7,278,727 | 7,417,141 |
| 7,452,989 | 7,367,665 | 7,138,391 | 7,153,956 | 7,423,145 |
| 7,456,277 | 7,550,585 | 7,122,076 | 7,148,345 | 7,470,315 |
| 7,572,327 | 7,658,792 | 7,709,633 | 11/482,985 | 11/454,899 |
| 7,416,280 | 7,252,366 | 7,488,051 | 7,360,865 | 11/482,967 |

-continued

| | | | | |
|---|---|---|---|---|
| 11/482,966 | 11/482,988 | 7,681,000 | 7,438,371 | 7,465,017 |
| 7,441,862 | 7,654,636 | 7,458,659 | 7,455,376 | 11/124,158 |
| 11/124,196 | 11/124,199 | 11/124,162 | 11/124,202 | 11/124,197 |
| 11/124,198 | 7,284,921 | 11/124,151 | 7,407,257 | 7,470,019 |
| 7,645,022 | 7,392,950 | 11/124,149 | 7,360,880 | 7,517,046 |
| 7,236,271 | 11/124,174 | 11/124,194 | 11/124,164 | 7,465,047 |
| 7,607,774 | 11/124,166 | 11/124,150 | 11/124,172 | 11/124,165 |
| 7,566,182 | 11/124,185 | 11/124,184 | 11/124,182 | 7,715,036 |
| 11/124,171 | 11/124,181 | 7,697,159 | 7,595,904 | 11/124,191 |
| 11/124,159 | 7,370,932 | 7,404,616 | 11/124,187 | 11/124,189 |
| 11/124,190 | 7,500,268 | 7,558,962 | 7,447,908 | 11/124,178 |
| 7,661,813 | 7,456,994 | 7,431,449 | 7,466,444 | 11/124,179 |
| 7,680,512 | 11/187,976 | 11/188,011 | 7,562,973 | 7,530,446 |
| 11/228,540 | 11/228,500 | 7,668,540 | 11/228,530 | 11/228,490 |
| 11/228,531 | 11/228,504 | 11/228,533 | 11/228,502 | 11/228,507 |
| 7,708,203 | 11/228,505 | 7,641,115 | 7,697,714 | 7,654,444 |
| 11/228,484 | 7,499,765 | 11/228,518 | 11/228,536 | 11/228,496 |
| 7,558,563 | 11/228,506 | 11/228,516 | 11/228,526 | 11/228,539 |
| 11/228,538 | 11/228,524 | 11/228,523 | 7,506,802 | 11/228,528 |
| 11/228,527 | 7,403,797 | 11/228,520 | 7,646,503 | 11/228,511 |
| 7,672,664 | 11/228,515 | 11/228,537 | 11/228,534 | 11/228,491 |
| 11/228,499 | 11/228,509 | 11/228,492 | 7,558,599 | 11/228,510 |
| 11/228,508 | 11/228,512 | 11/228,514 | 11/228,494 | 7,438,215 |
| 7,689,249 | 7,621,442 | 7,575,172 | 7,357,311 | 7,380,709 |
| 7,428,986 | 7,403,796 | 7,407,092 | 11/228,513 | 7,637,424 |
| 7,469,829 | 11/228,535 | 7,558,597 | 7,558,598 | 6,238,115 |
| 6,386,535 | 6,398,344 | 6,612,240 | 6,752,549 | 6,805,049 |
| 6,971,313 | 6,899,480 | 6,860,664 | 6,925,935 | 6,966,636 |
| 7,024,995 | 7,284,852 | 6,926,455 | 7,056,038 | 6,869,172 |
| 7,021,843 | 6,988,845 | 6,964,533 | 6,981,809 | 7,284,822 |
| 7,258,067 | 7,322,757 | 7,222,941 | 7,284,925 | 7,278,795 |
| 7,249,904 | 7,152,972 | 11/246,687 | 7,645,026 | 7,322,681 |
| 7,708,387 | 11/246,703 | 7,712,884 | 7,510,267 | 7,465,041 |
| 11/246,712 | 7,465,032 | 7,401,890 | 7,401,910 | 7,470,010 |
| 11/246,702 | 7,431,432 | 7,465,037 | 7,445,317 | 7,549,735 |
| 7,597,425 | 7,661,800 | 7,712,869 | 7,156,508 | 7,159,972 |
| 7,083,271 | 7,165,834 | 7,080,894 | 7,201,469 | 7,090,336 |
| 7,156,489 | 7,413,283 | 7,438,385 | 7,083,257 | 7,258,422 |
| 7,255,423 | 7,219,980 | 7,591,533 | 7,416,274 | 7,367,649 |
| 7,118,192 | 7,618,121 | 7,322,672 | 7,077,505 | 7,198,354 |
| 7,077,504 | 7,614,724 | 7,198,355 | 7,401,894 | 7,322,676 |
| 7,152,959 | 7,213,906 | 7,178,901 | 7,222,938 | 7,108,353 |
| 7,104,629 | 7,455,392 | 7,370,939 | 7,429,095 | 7,404,621 |
| 7,261,401 | 7,461,919 | 7,438,388 | 7,328,972 | 7,322,673 |
| 7,303,930 | 7,401,405 | 7,464,466 | 7,464,465 | 7,246,886 |
| 7,128,400 | 7,108,355 | 6,991,322 | 7,287,836 | 7,118,197 |
| 7,575,298 | 7,364,269 | 7,077,493 | 6,962,402 | 7,686,429 |
| 7,147,308 | 7,524,034 | 7,118,198 | 7,168,790 | 7,172,270 |
| 7,229,155 | 6,830,318 | 7,195,342 | 7,175,261 | 7,465,035 |
| 7,108,356 | 7,118,202 | 7,510,269 | 7,134,744 | 7,510,270 |
| 7,134,743 | 7,182,439 | 7,210,768 | 7,465,036 | 7,134,745 |
| 7,156,484 | 7,118,201 | 7,111,926 | 7,431,433 | 7,018,021 |
| 7,401,901 | 7,468,139 | 7,128,402 | 7,387,369 | 7,484,832 |
| 11/490,041 | 7,506,968 | 7,284,839 | 7,246,885 | 7,229,156 |
| 7,533,970 | 7,467,855 | 7,293,858 | 7,258,427 | 7,448,729 |
| 7,246,876 | 7,431,431 | 7,419,249 | 7,377,623 | 7,328,978 |
| 7,334,876 | 7,147,306 | 7,654,645 | 11/482,977 | 09/575,197 |
| 7,079,712 | 6,825,945 | 7,330,974 | 6,813,039 | 6,987,506 |
| 7,038,797 | 6,980,318 | 6,816,274 | 7,102,772 | 7,350,236 |
| 6,681,045 | 6,728,000 | 7,173,722 | 7,088,459 | 7,707,082 |
| 7,068,382 | 7,062,651 | 6,789,194 | 6,789,191 | 6,644,642 |
| 6,502,614 | 6,622,999 | 6,669,385 | 6,549,935 | 6,987,573 |
| 6,727,996 | 6,591,884 | 6,439,706 | 6,760,119 | 7,295,332 |
| 6,290,349 | 6,428,155 | 6,785,016 | 6,870,966 | 6,822,639 |
| 6,737,591 | 7,055,739 | 7,233,320 | 6,830,196 | 6,832,717 |
| 6,957,768 | 7,456,820 | 7,170,499 | 7,106,888 | 7,123,239 |
| 10/727,162 | 7,377,608 | 7,399,043 | 7,121,639 | 7,165,824 |
| 7,152,942 | 10/727,157 | 7,181,572 | 7,096,137 | 7,302,592 |
| 7,278,034 | 7,188,282 | 7,592,829 | 10/727,180 | 10/727,179 |
| 10/727,192 | 10/727,274 | 7,707,621 | 7,523,111 | 7,573,301 |
| 7,660,998 | 10/754,536 | 10/754,938 | 10/727,160 | 7,171,323 |
| 7,278,697 | 7,360,131 | 7,519,772 | 7,328,115 | 7,369,270 |
| 6,795,215 | 7,070,098 | 7,154,638 | 6,805,419 | 6,859,289 |
| 6,977,751 | 6,398,332 | 6,394,573 | 6,622,923 | 6,747,760 |
| 6,921,144 | 10/884,881 | 7,092,112 | 7,192,106 | 7,457,001 |
| 7,173,739 | 6,986,560 | 7,008,033 | 7,551,324 | 7,222,780 |
| 7,270,391 | 7,525,677 | 7,388,689 | 7,571,906 | 7,195,328 |
| 7,182,422 | 7,374,266 | 7,427,117 | 7,448,707 | 7,281,330 |
| 10/854,503 | 7,328,956 | 10/854,509 | 7,188,928 | 7,093,989 |
| 7,377,609 | 7,600,843 | 10/854,498 | 10/854,511 | 7,390,071 |

-continued

| | | | | |
|---|---|---|---|---|
| 10/854,525 | 10/854,526 | 7,549,715 | 7,252,353 | 7,607,757 |
| 7,267,417 | 10/854,505 | 7,517,036 | 7,275,805 | 7,314,261 |
| 7,281,777 | 7,290,852 | 7,484,831 | 10/854,523 | 10/854,527 |
| 7,549,718 | 10/854,520 | 7,631,190 | 7,557,941 | 10/854,499 |
| 10/854,501 | 7,266,661 | 7,243,193 | 10/854,518 | 10/934,628 |
| 7,163,345 | 7,322,666 | 7,465,033 | 7,452,055 | 7,470,002 |
| 11/293,833 | 7,475,963 | 7,448,735 | 7,465,042 | 7,448,739 |
| 7,438,399 | 11/293,794 | 7,467,853 | 7,461,922 | 7,465,020 |
| 11/293,830 | 7,461,910 | 11/293,828 | 7,270,494 | 7,632,032 |
| 7,475,961 | 7,547,088 | 7,611,239 | 11/293,819 | 11/293,818 |
| 7,681,876 | 11/293,816 | 7,703,903 | 7,448,734 | 7,425,050 |
| 7,364,263 | 7,201,468 | 7,360,868 | 7,234,802 | 7,303,255 |
| 7,287,846 | 7,156,511 | 10/760,264 | 7,258,432 | 7,097,291 |
| 7,645,025 | 10/760,248 | 7,083,273 | 7,367,647 | 7,374,355 |
| 7,441,880 | 7,547,092 | 10/760,206 | 7,513,598 | 10/760,270 |
| 7,198,352 | 7,364,264 | 7,303,251 | 7,201,470 | 7,121,655 |
| 7,293,861 | 7,232,208 | 7,328,985 | 7,344,232 | 7,083,272 |
| 7,311,387 | 7,621,620 | 7,669,961 | 7,331,663 | 7,360,861 |
| 7,328,973 | 7,427,121 | 7,407,262 | 7,303,252 | 7,249,822 |
| 7,537,309 | 7,311,382 | 7,360,860 | 7,364,257 | 7,390,075 |
| 7,350,896 | 7,429,096 | 7,384,135 | 7,331,660 | 7,416,287 |
| 7,488,052 | 7,322,684 | 7,322,685 | 7,311,381 | 7,270,405 |
| 7,303,268 | 7,470,007 | 7,399,072 | 7,393,076 | 7,681,967 |
| 7,588,301 | 7,249,833 | 7,524,016 | 7,490,927 | 7,331,661 |
| 7,524,043 | 7,300,140 | 7,357,492 | 7,357,493 | 7,566,106 |
| 7,380,902 | 7,284,816 | 7,284,845 | 7,255,430 | 7,390,080 |
| 7,328,984 | 7,350,913 | 7,322,671 | 7,380,910 | 7,431,424 |
| 7,470,006 | 7,585,054 | 7,347,534 | 7,441,865 | 7,469,989 |
| 7,367,650 | 7,469,990 | 7,441,882 | 7,556,364 | 7,357,496 |
| 7,467,863 | 7,431,440 | 7,431,443 | 7,527,353 | 7,524,023 |
| 7,513,603 | 7,467,852 | 7,465,045 | 7,645,034 | 7,637,602 |
| 7,645,033 | 7,661,803 | 11/495,819 | | |

BACKGROUND OF THE INVENTION

Inkjet printers eject drops of ink through an array of nozzles to effect printing on a media substrate. The nozzles are typically formed on a silicon wafer substrate using semiconductor fabrication techniques. Each nozzle is a MEMS (micro electro-mechanical systems) device driven by associated drive circuitry formed on the same silicon wafer substrate. The MEMS nozzle devices and associated drive circuitry formed on a single nozzle is commonly referred to as a printhead integrated circuit (IC).

Some inkjet printheads have a single printhead IC. These are scanning type printheads that traverse back and forth across the width of a page as the printer indexes the length of the page past the printhead. The Applicant has developed a range of pagewidth printheads that have a nozzle array as long as the printing width of the page. These printheads remain stationary in the printer as the page is fed past. This allows much higher print speeds but is more complicated in terms of controlling the operation of a much larger array of nozzles.

The pagewidth array of nozzles is made up of a series of separate printhead IC's placed end to end. Skilled workers in this field will appreciate that more printhead IC's can be fabricated on the unprocessed circular silicon wafers if each IC is short rather than long. Furthermore, localized fabrication defects can render an entire printhead IC defective. Hence there is less chance that each individual IC will be defective if they are shorter.

The print data for each printhead IC in the pagewidth array of nozzles, is generated by another microprocessor in the printer, often referred to as a print engine controller (PEC). With the pagewidth array consisting of a series of separate printhead IC's, and each printhead IC needing a print data signal and a clocking signal at the least, the total number of connections between the PEC and the pagewidth array of printhead IC's can be numerous.

The Applicant has found that it is beneficial to provide the pagewidth printhead in the form of a replaceable cartridge. If nozzle clogging or actuator burn out reduce the print quality to an unacceptable level, the user simply replaces the printhead instead of the entire printer. However, user expectation demands that the printhead replacement process be as simple and failsafe as possible. Therefore, the number of interconnections between the PEC and the printhead should be minimized.

SUMMARY OF THE INVENTION

According to a first aspect, the present invention provides a printhead IC for an inkjet printer, the inkjet printer having a PEC for sending print data to the printhead IC, the printhead IC comprising:

an array of nozzles for ejecting drops of printing fluid onto a media substrate; and, drive circuitry for driving the array of nozzles, the drive circuitry being configured to extract a clock signal from the data transmission from the PEC.

By incorporating a clocking signal into the print data signal, the number of connections between the PEC and the printhead IC's. This is particularly beneficial if the pagewidth printhead is provided as a replaceable cartridge as the electrical interface that the cartridge mates with upon insertion has less contacts and therefore easier to install. Giving all the printhead IC's a write address and daisy-chaining the IC's together via their data outputs, allows the PEC to have a single data in line and a single data out line. In this case the electrical interface only has two contacts.

By initializing the printhead IC's in response to power up, the PEC/printhead IC's interface does not need a separate reset line connected to each of the IC's. In fact, the PEC can have as little as two electrical connections. There is no need to initialize the printhead IC's using. A 'data in' from the PEC to the printhead IC's and a 'data out' line from the printhead IC's back to the PEC are the only connections required if the print data is sent via a self clocking data signal. If the data in signal is not self clocking, it will need to have a clock line through the PEC/printhead IC interface.

Optionally, the data transmission is a digital signal that has a rising edge at every clock period.

Optionally, the drive circuitry determines a data bit from every clock period by the position of the falling edge during that period.

In another aspect the present invention provides a printhead IC linked with other like printhead IC's to form a pagewidth printhead, wherein the data transmission is multidropped to all the printhead IC's and each printhead IC has a unique write address provided by the PEC.

Optionally, the interface between the printhead and the PEC has only two connections.

In another aspect the present invention provides a printhead IC further comprising a plurality of temperature sensors positioned along the array of nozzles such that the drive circuitry adjusts the drive pulses in response to the temperature sensor outputs.

Optionally, each of the plurality of temperature sensors is activated sequentially for a period of time during the print job.

Optionally, the plurality of temperatures sensors are divided into two or more groups, each group being activated for a sensing period in accordance with a predetermined repeating sequence for the duration of a print job.

Optionally, each of the plurality of temperature sensors, is configured to sense the temperature a corresponding region of the array such that the drive pulse for the nozzles in one region can differs from the drive pulse for the nozzles in another region.

Optionally, every second temperature sensor in the plurality of temperature sensors is de-activated such that the drive circuitry adjusts the drive pulse profile for the region corresponding to each activated temperature sensor and applies the same adjustment to the adjacent region where the temperature sensor is de-activated.

Optionally, the drive circuitry is programmed with a series of temperature thresholds defining a set of temperature zones, each of the zones having a different pulse profile for the drive pulses sent to the nozzles in the region currently operating in that temperature zone.

Optionally, the pulse profile for each temperature zone differs in its duration.

Optionally, the drive circuitry sets the pulse duration to zero if the temperature sensor indicates that region is operating at a temperature above the highest of the temperature thresholds.

Optionally, the drive circuitry sets the duration of the pulse profile to a sub ejection value for any of the nozzles in the row that are not to eject a drop during that firing sequence.

In another aspect the present invention provides a printhead IC mounted to a pagewidth printhead with a plurality of like printhead IC's, wherein all the printhead IC's have a common initial address with one exception, the exception having a different address such that the print engine controller sends a first instruction to any printhead IC's having the different address, the first broadcast instruction instructing the printhead IC having the different address to change its address to a first unique address, the printhead IC's being connected to each other such that once the exception has changed its address to the first unique address, it causes one of the printhead IC's having a common address to change its address to the different address, so that when the print engine controller sends a second broadcast instruction to the different address, the printhead IC with the different address changes its address to a second unique address as well as causing one of the remaining printhead IC's having the common address to change to a different address, the process repeating until the print engine controller assigns the printhead IC's with mutually unique addresses.

In another aspect the present invention provides a printhead IC further comprising open actuator test circuitry for selectively disabling the actuators when they receive a drive signal while comparing the resistance of the resistive heater to a predetermined threshold to assess whether the actuator is defective.

Optionally, during use feedback from the open actuator test circuitry is used to adjust the print data subsequently received by the drive circuitry.

Optionally, the drive circuitry is configured to operate in two modes, a printing mode in which the drive pulses it generates are printing pulses, and a maintenance mode in which the drive pulses are de-clog pulses, such that, the de-clog pulse has a longer duration than the printing pulse.

Optionally, the drive circuitry resets itself to a known initial state in response to receiving power from a power source after a period of not receiving power from the power source.

Optionally, the drive circuitry is configured to receive the print data in any one of a plurality of different data transmission protocols.

According to a second aspect, the present invention provides a printhead IC comprising:

an array of nozzles;

an ejection actuator corresponding to each of the nozzles respectively, the ejection actuator having a resistive heater that is activated when the actuator ejects ink through the corresponding nozzle;

drive circuitry for receiving print data and activating the actuators with drive signals in accordance with the print data; and, open actuator test circuitry for selectively disabling the actuators when they receive a drive signal while comparing the resistance of the resistive heater to a predetermined threshold to assess whether the actuator is defective.

In thermal inkjet printheads and thermal bend inkjet printheads, the vast majority of failures are the result of the resistive heater burning out and breaking or 'going open circuit'. Nozzles may fail to eject ink because of clogging but this is not a 'dead nozzle' and may be recovered through the printer maintenance regime. By determining which nozzles are dead with an inbuilt circuit, the print engine controller can periodically update its dead nozzle map and thereby extend to operational life of the printhead.

Preferably the open actuator test circuitry generates defective nozzle feedback during print jobs. In a further preferred form the open actuator test circuitry generates defective nozzle feedback within a predetermined time period after printhead operation. In a particularly preferred form, the open actuator test circuitry generates defective nozzle feedback between each page of a print job. Preferably the drive circuitry has an actuator FET (field effect transistor) that is enabled by a drive signal to open the resistive heater to a drive voltage, and the open actuator test circuitry has NAND logic with the drive signal and an actuator test signal as inputs and outputs to the gate of the actuator FET. Preferably, the open actuator test circuitry has a sense FET with a source connected to the high voltage side of the resistive heater and a drain connected to a sense electrode, the sense FET being enabled by the test signal such that a low voltage output to the sense electrode is fed back as a functional actuator and a high voltage output to the sense electrode is fed back as a defective actuator.

Optionally, during use feedback from the open actuator test circuitry is used to adjust the print data subsequently received by the drive circuitry.

Optionally, the open actuator test circuitry generates defective nozzle feedback during print jobs.

Optionally, the open actuator test circuitry generates defective nozzle feedback within a predetermined time period after printhead operation.

Optionally, the open actuator test circuitry generates defective nozzle feedback between each page of a print job.

Optionally, the drive circuitry has a drive FET controlling current to the resistive heater and logic for enabling the drive FET when a drive signal is received and disabling the drive FET when a drive signal and a open actuator test signal are received.

Optionally, the drive circuitry has a bleed FET that slowly drains any voltage drop across the resistive heater to zero when the drive circuitry is not receiving a drive signal or an open actuator test signal.

Optionally, the drive circuitry has a sense node between the drain of the drive FET and the resistive heater, and the open actuator test circuitry has a sense FET that is enabled when open actuator test signal is received such that the voltage at the drain of the sense FET is used to indicate whether the heater element is defective.

Optionally, the drive FET is a p-type FET.

Optionally, the drive circuitry receives the print data for the array in a plurality of sequential portions with a fire command at the end of each portion.

In a further aspect the present invention provides a printhead IC further comprising a plurality of temperature sensors for sensing the temperature of the printhead IC within each of the regions respectively.

Optionally, the drive circuitry adjusts the drive pulses sent to the nozzles in accordance with the temperature of the printing fluid within the nozzles.

Optionally, the drive circuitry blocks the dive pulses sent to at least some of the nozzles in the array when one or more of the temperature sensors indicate the temperature exceeds a predetermined maximum.

Optionally, the drive pulses consist of ejection pulses with sufficient energy to eject printing fluid from the nozzles designated to fire at that time, and sub-ejection pulses with insufficient energy to eject printing fluid from the nozzles not designated to fire at that time.

Optionally, during use the drive circuitry adjusts the drive pulse profile in response to the temperature sensor output.

Optionally, during use, the temperature sensor can be deactivated after a period of use.

Optionally, the drive circuitry delays sending the drive pulses to one of the groups relative to at least one of the other groups.

Optionally, each row of nozzles is divided into a plurality of groups, each having at least one nozzle the drive circuitry delays sending the drive pulses to one of the groups relative to at least one of the other groups.

Optionally, during use the drive circuitry actuates the nozzles in the row in accordance with a firing sequence, the firing sequence enabling the nozzles in each group to eject printing fluid simultaneously, and enabling each of the groups to eject printing fluid in succession such that, the nozzles in each group are spaced from each other by at least a predetermined minimum number of nozzles and, each of the nozzles in a group is spaced from the nozzles in the subsequently enabled group by at least the predetermined minimum number of nozzles.

Optionally, the drive circuitry is configured to operate in two modes, a printing mode in which the drive pulses it generates are printing pulses, and a maintenance mode in which the drive pulses are de-clog pulses, such that, the de-clog pulse has a longer duration than the printing pulse.

According to a third aspect, the present invention provides a printhead IC comprising:

an array of nozzles;

drive circuitry for receiving print data and fire commands from a print engine controller; wherein during use, the drive circuitry receives the print data for the array in a plurality of sequential portions with a fire command at the end of each portion.

Instead of providing a shift register for each nozzle in the array, the printhead IC only has enough dot data shift registers for a portion of the nozzle array which it fires while the shift register load with the dot data for the next portion of the array. This moves the shift register out of the unit cell (the smallest repeating unit of nozzles and corresponding ink chamber, actuator and drive circuitry) which allows the drive FET to be larger while not impacting on the nozzle density. As discussed above, a larger drive FET can generate a drive pulse at higher power levels for more efficient drop ejection.

Preferably, the array is configured into rows and columns, and the sequential portions are the nozzles in each individual row such that the rows eject printing fluid one row at a time. In a further preferred form, the drive circuitry is configured to fire the rows in a predetermined sequence and the print engine controller sends the print data for each row to the drive circuitry in the predetermined sequence. In a particularly preferred form, the print data for the next row in the predetermined sequence is loaded as the previous row is fired. Preferably, the nozzles in each of the rows eject the same type of printing fluid.

Optionally, the array is configured into rows and columns, and the sequential portions are the nozzles in each individual row such that the rows eject printing fluid one row at a time.

Optionally, the drive circuitry is configured to fire the rows in a predetermined sequence and the print engine controller sends the print data for each row to the drive circuitry in the predetermined sequence.

Optionally, the print data for the next row in the predetermined sequence is loaded as the previous row is fired.

Optionally, the nozzles in each of the rows eject the same type of printing fluid.

In a further aspect there is provided a printhead IC further comprising open actuator test circuitry for selectively disabling the actuators when they receive a drive signal while comparing the resistance of the resistive heater to a predetermined threshold to assess whether the actuator is defective.

Optionally, during use feedback from the open actuator test circuitry is used to adjust the print data subsequently received by the drive circuitry.

Optionally, the open actuator test circuitry generates defective nozzle feedback during print jobs.

In a further aspect there is provided a printhead IC according further comprising a plurality of temperature sensors for sensing the temperature of the printhead IC within each of the regions respectively.

Optionally, the drive circuitry adjusts the drive pulses sent to the nozzles in accordance with the temperature of the printing fluid within the nozzles.

Optionally, the drive circuitry blocks the dive pulses sent to at least some of the nozzles in the array when one or more of the temperature sensors indicate the temperature exceeds a predetermined maximum.

Optionally, the drive pulses consist of ejection pulses with sufficient energy to eject printing fluid from the nozzles designated to fire at that time, and sub-ejection pulses with insufficient energy to eject printing fluid from the nozzles not designated to fire at that time.

Optionally, during use the drive circuitry adjusts the drive pulse profile in response to the temperature sensor output.

Optionally, during use, the temperature sensor can be deactivated after a period of use.

Optionally, the drive circuitry delays sending the drive pulses to one of the groups relative to at least one of the other groups.

Optionally, each row of nozzles is divided into a plurality of groups, each having at least one nozzle the drive circuitry delays sending the drive pulses to one of the groups relative to at least one of the other groups.

Optionally, during use the drive circuitry actuates the nozzles in the row in accordance with a firing sequence, the firing sequence enabling the nozzles in each group to eject printing fluid simultaneously, and enabling each of the groups to eject printing fluid in succession such that, the nozzles in each group are spaced from each other by at least a predetermined minimum number of nozzles and, each of the nozzles in a group is spaced from the nozzles in the subsequently enabled group by at least the predetermined minimum number of nozzles.

Optionally, the drive circuitry is configured to operate in two modes, a printing mode in which the drive pulses it generates are printing pulses, and a maintenance mode in which the drive pulses are de-clog pulses, such that, the de-clog pulse has a longer duration than the printing pulse.

Optionally, the drive circuitry extracts a clock signal from the print data transmission from the PEC.

Optionally, the drive circuitry resets itself to a known initial state in response to receiving power from a power source after a period of not receiving power from the power source.

Optionally, the drive circuitry is configured to receive the print data in any one of a plurality of different data transmission protocols.

According to a fourth aspect, the present invention provides a printhead IC comprising:

an array of nozzles having a plurality of adjacent regions; and, drive circuitry for sending an electrical pulse to each of the nozzles individually such that they eject a drop of printing fluid; and, a plurality of temperature sensors for sensing the temperature of the printhead IC within each of the regions respectively.

Monitoring the temperature across the printhead IC with several sensors gives the drive circuitry a temperature profile of the ink in different regions. Using the feedback from the sensors, the drive pulse sent to the nozzles in each region can be adjusted to best suit the current viscosity of the ink. By compensating for any ink viscosity differences, the drop ejection characteristics are kept uniform across the entire printhead IC, and thereby the whole pagewidth printhead. As discussed above, uniform drop ejection improves the print quality.

Preferably, the drive circuitry is programmed with a series of temperature thresholds defining a set of temperature zones, each of the zones having a different pulse profile for the electrical pulses sent to the nozzles in the region currently operating in that temperature zone. In a further preferred form the pulse profile for each temperature zone differs in its duration. In a particularly preferred form, the associated drive circuitry sets the pulse duration to zero if the temperature sensor indicates that region is operating at a temperature above the highest of the temperature thresholds. In some embodiments, the array is arranged into rows and columns of nozzles and each of the regions are a plurality of adjacent columns, such that the drive circuitry is configured to fire the nozzles one row at a time. In specific forms of this embodiment, the drive circuitry enables the nozzles in the row to fire in a predetermined firing sequence. In some versions of this embodiment, the associated drive circuitry sets the duration of the pulse profile to a sub ejection value for any of the nozzles in the row that are not to eject a drop during that firing sequence.

Optionally, the drive circuitry is programmed with a series of temperature thresholds defining a set of temperature zones, each of the zones having a different pulse profile for the electrical pulses sent to the nozzles in the region currently operating in that temperature zone.

Optionally, the pulse profile for each temperature zone differs in its duration.

Optionally, the drive circuitry sets the pulse duration to zero if the temperature sensor indicates that region is operating at a temperature above the highest of the temperature thresholds.

Optionally, the array is arranged into rows and columns of nozzles and each of the regions are a plurality of adjacent columns, such that the drive circuitry is configured to fire the nozzles one row at a time.

Optionally, the drive circuitry enables the nozzles in the row to fire in a predetermined firing sequence.

Optionally, the drive circuitry sets the duration of the pulse profile to a sub ejection value for any of the nozzles in the row that are not to eject a drop during that firing sequence.

Optionally, the open actuator test circuitry generates defective nozzle feedback during print jobs.

In a further aspect the present invention provides a printhead IC mounted to a pagewidth printhead with a plurality of like printhead IC's, wherein all the printhead IC's have a common initial address with one exception, the exception having a different address such that the print engine controller sends a first instruction to any printhead IC's having the different address, the first broadcast instruction instructing the printhead IC having the different address to change its address to a first unique address, the printhead IC's being connected to each other such that once the exception has changed its address to the first unique address, it causes one of the printhead IC's having a common address to change its address to the different address, so that when the print engine controller sends a second broadcast instruction to the different address, the printhead IC with the different address changes its address to a second unique address as well as causing one of the remaining printhead IC's having the common address to change to a different address, the process repeating until the print engine controller assigns the printhead IC's with mutually unique addresses.

Optionally, the drive circuitry adjusts the drive pulses sent to the nozzles in accordance with the temperature of the printing fluid within the nozzles.

Optionally, the drive circuitry blocks the dive pulses sent to at least some of the nozzles in the array when one or more of the temperature sensors indicate the temperature exceeds a predetermined maximum.

Optionally, the drive pulses consist of ejection pulses with sufficient energy to eject printing fluid from the nozzles designated to fire at that time, and sub-ejection pulses with insufficient energy to eject printing fluid from the nozzles not designated to fire at that time.

Optionally, during use the drive circuitry adjusts the drive pulse profile in response to the temperature sensor output.

Optionally, during use, the temperature sensor can be deactivated after a period of use.

Optionally, the drive circuitry delays sending the drive pulses to one of the groups relative to at least one of the other groups.

Optionally, each row of nozzles is divided into a plurality of groups, each having at least one nozzle the drive circuitry delays sending the drive pulses to one of the groups relative to at least one of the other groups.

Optionally, during use the drive circuitry actuates the nozzles in the row in accordance with a firing sequence, the firing sequence enabling the nozzles in each group to eject printing fluid simultaneously, and enabling each of the groups to eject printing fluid in succession such that, the nozzles in each group are spaced from each other by at least a predetermined minimum number of nozzles and, each of the nozzles in a group is spaced from the nozzles in the subsequently enabled group by at least the predetermined minimum number of nozzles.

Optionally, the drive circuitry is configured to operate in two modes, a printing mode in which the drive pulses it generates are printing pulses, and a maintenance mode in which the drive pulses are de-clog pulses, such that, the de-clog pulse has a longer duration than the printing pulse.

Optionally, the drive circuitry extracts a clock signal from the print data transmission from the PEC.

Optionally, the drive circuitry resets itself to a known initial state in response to receiving power from a power source after a period of not receiving power from the power source.

Optionally, the drive circuitry is configured to receive the print data in any one of a plurality of different data transmission protocols.

According to a fifth aspect, the present invention provides a printhead IC comprising:

an array of nozzles; and, drive circuitry for sending an drive pulse to each of the nozzles individually such that they eject a drop of printing fluid; wherein, the drive circuitry adjusts the drive pulses sent to the nozzles in accordance with the temperature of the printing fluid within the nozzles.

Monitoring the temperature of individual printhead IC's allows the drive circuitry to compensate for any differences in ink viscosity between different printhead IC's of the pagewidth printhead. By compensating for any ink viscosity differences, the drop ejection characteristics are kept uniform across the entire printhead to improve the print quality.

Preferably, the printhead IC further comprises a plurality of temperature sensors, each for sensing the temperature the nozzles within a region of the array such that the drive pulse for the nozzles in one region differs from the drive pulse for the nozzles in another region in response to a temperature difference between the regions. Preferably, the drive circuitry is programmed with a series of temperature thresholds defining a set of temperature zones, each of the zones having a different pulse profile for the drive pulses sent to the nozzles in the region currently operating in that temperature zone. In a further preferred form the pulse profile for each temperature zone differs in its duration. In a particularly preferred form, the drive circuitry sets the pulse duration to zero if the temperature sensor indicates that region is operating at a temperature above the highest of the temperature thresholds. In some embodiments, the array is arranged into rows and columns of nozzles and each of the regions are a plurality of adjacent columns, such that the drive circuitry is configured to fire the nozzles one row at a time. In specific forms of this embodiment, the drive circuitry enables the nozzles in the row to fire in a predetermined firing sequence. In some versions of this embodiment, the drive circuitry sets the duration of the pulse profile to a sub ejection value for any of the nozzles in the row that are not to eject a drop during that firing sequence.

In a further aspect the present invention provides a printhead IC further comprises a plurality of temperature sensors, each for sensing the temperature the nozzles within a region of the array such that the drive pulse for the nozzles in one region differs from the drive pulse for the nozzles in another region in response to a temperature difference between the regions.

Optionally, the drive circuitry is programmed with a series of temperature thresholds defining a set of temperature zones, each of the zones having a different pulse profile for the drive pulses sent to the nozzles in the region currently operating in that temperature zone.

Optionally, the pulse profile for each temperature zone differs in its duration.

Optionally, the drive circuitry sets the pulse duration to zero if the temperature sensor indicates that region is operating at a temperature above the highest of the temperature thresholds.

Optionally, the array is arranged into rows and columns of nozzles and each of the regions are a plurality of adjacent columns, such that the drive circuitry is configured to fire the nozzles one row at a time.

Optionally, the drive circuitry enables the nozzles in the row to fire in a predetermined firing sequence.

Optionally, the drive circuitry sets the duration of the pulse profile to a sub ejection value for any of the nozzles in the row that are not to eject a drop during that firing sequence.

In a further aspect the present invention provides a printhead IC mounted to a pagewidth printhead with a plurality of like printhead IC's, wherein all the printhead IC's have a common initial address with one exception, the exception having a different address such that the print engine controller sends a first instruction to any printhead IC's having the different address, the first broadcast instruction instructing the printhead IC having the different address to change its address to a first unique address, the printhead IC's being connected to each other such that once the exception has changed its address to the first unique address, it causes one of the printhead IC's having a common address to change its address to the different address, so that when the print engine controller sends a second broadcast instruction to the different address, the printhead IC with the different address changes its address to a second unique address as well as causing one of the remaining printhead IC's having the common address to change to a different address, the process repeating until the print engine controller assigns the printhead IC's with mutually unique addresses.

In a further aspect the present invention provides a printhead IC further comprising open actuator test circuitry for selectively disabling the actuators when they receive a drive signal while comparing the resistance of the resistive heater to a predetermined threshold to assess whether the actuator is defective.

Optionally, the drive circuitry blocks the drive pulses sent to at least some of the nozzles in the array when one or more of the temperature sensors indicate the temperature exceeds a predetermined maximum.

Optionally, the drive pulses consist of ejection pulses with sufficient energy to eject printing fluid from the nozzles designated to fire at that time, and sub-ejection pulses with insufficient energy to eject printing fluid from the nozzles not designated to fire at that time.

Optionally, during use the drive circuitry adjusts the drive pulse profile in response to the temperature sensor output.

Optionally, during use, the temperature sensor can be deactivated after a period of use.

Optionally, the drive circuitry delays sending the drive pulses to one of the groups relative to at least one of the other groups.

Optionally, each row of nozzles is divided into a plurality of groups, each having at least one nozzle the drive circuitry delays sending the drive pulses to one of the groups relative to at least one of the other groups.

Optionally, during use the drive circuitry actuates the nozzles in the row in accordance with a firing sequence, the firing sequence enabling the nozzles in each group to eject printing fluid simultaneously, and enabling each of the groups to eject printing fluid in succession such that, the nozzles in each group are spaced from each other by at least a predetermined minimum number of nozzles and, each of the nozzles in a group is spaced from the nozzles in the subsequently enabled group by at least the predetermined minimum number of nozzles.

Optionally, the drive circuitry is configured to operate in two modes, a printing mode in which the drive pulses it generates are printing pulses, and a maintenance mode in which the drive pulses are de-clog pulses, such that, the de-clog pulse has a longer duration than the printing pulse.

Optionally, the drive circuitry extracts a clock signal from the print data transmission from the PEC.

Optionally, the drive circuitry resets itself to a known initial state in response to receiving power from a power source after a period of not receiving power from the power source.

Optionally, the drive circuitry is configured to receive the print data in any one of a plurality of different data transmission protocols.

According to a sixth aspect, the present invention provides a printhead IC comprising:

an array of nozzles; and, drive circuitry for sending an drive pulse to each of the nozzles individually such that they eject a drop of printing fluid; and, a temperature sensor for sensing the temperature of printing fluid within the array; wherein, the drive circuitry blocks the drive pulses sent to at least some of the nozzles in the array when the sensor indicates the temperature exceeds a predetermined maximum.

De-activating the heaters at a maximum temperature effectively aborts the print job but prevents nozzle burn-out. An overheating safeguard allows the nozzles to be recovered when the problem has been remedied.

Preferably, the drive circuitry reduces the duration the drive pulses as the temperatures of the printing fluid approaches the predetermined maximum such that the direction at the predetermined maximum is zero.

Monitoring the temperature of individual printhead IC's allows the drive circuitry to compensate for any differences in ink viscosity between different printhead IC's of the pagewidth printhead. By compensating for any ink viscosity differences, the drop ejection characteristics are kept uniform across the entire printhead to improve the print quality.

Preferably, the printhead IC further comprises a plurality of temperature sensors, each for sensing the temperature the nozzles within a region of the array such that the drive pulse for the nozzles in one region differs from the drive pulse for the nozzles in another region in response to a temperature difference between the regions. Preferably, the drive circuitry is programmed with a series of temperature thresholds defining a set of temperature zones, each of the zones having a different pulse profile for the drive pulses sent to the nozzles in the region currently operating in that temperature zone. In some embodiments, the array is arranged into rows and columns of nozzles and each of the regions are a plurality of adjacent columns, such that the drive circuitry is configured to fire the nozzles one row at a time. In specific forms of this embodiment, the drive circuitry enables the nozzles in the row to fire in a predetermined firing sequence. In some versions of this embodiment, the drive circuitry sets the duration of the pulse profile to a sub ejection value for any of the nozzles in the row that are not to eject a drop during that firing sequence.

Optionally, the drive circuitry reduces the duration the drive pulses as the temperatures of the printing fluid approaches the predetermined maximum such that the direction at the predetermined maximum is zero.

In a further aspect the present invention provides a printhead IC further comprising a plurality of temperature sensors, each for sensing the temperature the nozzles within a region of the array such that the drive pulse for the nozzles in one region differs from the drive pulse for the nozzles in another region in response to a temperature difference between the regions.

Optionally, the drive circuitry is programmed with a series of temperature thresholds defining a set of temperature zones, each of the zones having a different pulse profile for the drive pulses sent to the nozzles in the region currently operating in that temperature zone.

Optionally, the array is arranged into rows and columns of nozzles and each of the regions are a plurality of adjacent columns, such that the drive circuitry is configured to fire the nozzles one row at a time.

Optionally, the drive circuitry enables the nozzles in the row to fire in a predetermined firing sequence.

Optionally, the drive circuitry sets the duration of the pulse profile to a sub ejection value for any of the nozzles in the row that are not to eject a drop during that firing sequence.

Optionally, the drive circuitry sets the duration of the pulse profile to a sub ejection value for any of the nozzles in the row that are not to eject a drop during that firing sequence.

In a further aspect the present invention provides a printhead IC mounted to a pagewidth printhead with a plurality of like printhead IC's, wherein all the printhead IC's have a common initial address with one exception, the exception having a different address such that the print engine controller sends a first instruction to any printhead IC's having the different address, the first broadcast instruction instructing the printhead IC having the different address to change its address to a first unique address, the printhead IC's being connected to each other such that once the exception has changed its address to the first unique address, it causes one of the printhead IC's having a common address to change its address to the different address, so that when the print engine controller sends a second broadcast instruction to the different address, the printhead IC with the different address changes its address to a second unique address as well as causing one of the remaining printhead IC's having the common address to change to a different address, the process repeating until the print engine controller assigns the printhead IC's with mutually unique addresses.

In a further aspect the present invention provides a printhead IC further comprising open actuator test circuitry for selectively disabling the actuators when they receive a drive signal while comparing the resistance of the resistive heater to a predetermined threshold to assess whether the actuator is defective.

Optionally, during use feedback from the open actuator test circuitry is used to adjust the print data subsequently received by the drive circuitry.

Optionally, the drive pulses consist of ejection pulses with sufficient energy to eject printing fluid from the nozzles designated to fire at that time, and sub-ejection pulses with insufficient energy to eject printing fluid from the nozzles not designated to fire at that time.

Optionally, during use the drive circuitry adjusts the drive pulse profile in response to the temperature sensor output.

Optionally, during use, the temperature sensor can be de-activated after a period of use.

Optionally, the drive circuitry delays sending the drive pulses to one of the groups relative to at least one of the other groups.

Optionally, each row of nozzles is divided into a plurality of groups, each having at least one nozzle the drive circuitry delays sending the drive pulses to one of the groups relative to at least one of the other groups.

Optionally, during use the drive circuitry actuates the nozzles in the row in accordance with a firing sequence, the firing sequence enabling the nozzles in each group to eject printing fluid simultaneously, and enabling each of the groups to eject printing fluid in succession such that, the nozzles in each group are spaced from each other by at least a predetermined minimum number of nozzles and, each of the nozzles in a group is spaced from the nozzles in the subsequently enabled group by at least the predetermined minimum number of nozzles.

Optionally, the drive circuitry is configured to operate in two modes, a printing mode in which the drive pulses it generates are printing pulses, and a maintenance mode in which the drive pulses are de-clog pulses, such that, the de-clog pulse has a longer duration than the printing pulse.

Optionally, the drive circuitry extracts a clock signal from the print data transmission from the PEC.

Optionally, the drive circuitry resets itself to a known initial state in response to receiving power from a power source after a period of not receiving power from the power source.

Optionally, the drive circuitry is configured to receive the print data in any one of a plurality of different data transmission protocols.

According to a seventh aspect, the present invention provides a printhead IC comprising:

an array of nozzles; and, drive circuitry for receiving print data and sending drive pulses to the nozzles in accordance with the print data; wherein, the drive pulses consist of ejection pulses with sufficient energy to eject printing fluid from the nozzles designated to fire at that time, and sub-ejection pulses with insufficient energy to eject printing fluid from the nozzles not designated to fire at that time.

The drive circuitry sends an drive pulse to every nozzle in the array regardless of whether the print data has designated it to be a firing nozzle at that time. The non-firing nozzles are sent a sub-ejection pulse that is not enough to eject a drop of ink, but does maintain the temperature of the ink at the nozzle so that when next it fires, its ink temperature, and hence viscosity, is similar to that of the more frequently firing nozzles.

Preferably, the sub-ejection pulses have the same voltage and current as the ejection pulses, but a shorter duration. In a further preferred form, printhead IC further comprises a temperature sensor that has an output indicative of the temperature of at least part of the array wherein the drive circuitry sets the duration of the drive pulses to zero if the temperature sensor indicates that the temperature is above a predetermined maximum.

Preferably, the printhead IC further comprises a plurality of temperature sensors, each for sensing the temperature the nozzles within a region of the array such that the drive pulse for the nozzles in one region differs from the drive pulse for the nozzles in another region in response to a temperature difference between the regions. Preferably, the drive circuitry is programmed with a series of temperature thresholds defining a set of temperature zones, each of the zones having a different pulse profile for the drive pulses sent to the nozzles in the region currently operating in that temperature zone.

Monitoring the temperature of individual printhead IC's allows the drive circuitry to compensate for any differences in ink viscosity between different printhead IC's of the pagewidth printhead. By compensating for any ink viscosity differences, the drop ejection characteristics are kept uniform across the entire printhead to improve the print quality.

In some embodiments, the array is arranged into rows and columns of nozzles and each of the regions are a plurality of adjacent columns, such that the drive circuitry is configured to fire the nozzles one row at a time. In specific forms of this embodiment, the drive circuitry enables the nozzles in the row to fire in a predetermined firing sequence.

Optionally, the sub-ejection pulses have the same voltage and current as the ejection pulses, but a shorter duration.

In a further aspect the present invention provides a printhead IC further comprising a temperature sensor that has an output indicative of the temperature of at least part of the array wherein the drive circuitry sets the duration of the drive pulses to zero if the temperature sensor indicates that the temperature is above a predetermined maximum.

In a further aspect the present invention provides a printhead IC further comprising a plurality of temperature sensors, each for sensing the temperature the nozzles within a region of the array such that the drive pulse for the nozzles in one region differs from the drive pulse for the nozzles in another region in response to a temperature difference between the regions.

Optionally, the drive circuitry is programmed with a series of temperature thresholds defining a set of temperature zones, each of the zones having a different pulse profile for the drive pulses sent to the nozzles in the region currently operating in that temperature zone.

Optionally, the array is arranged into rows and columns of nozzles and each of the regions are a plurality of adjacent columns, such that the drive circuitry is configured to fire the nozzles one row at a time.

In a further aspect the present invention provides a printhead IC further comprising the drive circuitry enables the nozzles in the row to fire in a predetermined firing sequence.

Optionally, the drive circuitry sets the duration of the pulse profile to a sub ejection value for any of the nozzles in the row that are not to eject a drop during that firing sequence.

In a further aspect the present invention provides a printhead IC mounted to a pagewidth printhead with a plurality of like printhead IC's, wherein all the printhead IC's have a common initial address with one exception, the exception having a different address such that the print engine controller sends a first instruction to any printhead IC's having the different address, the first broadcast instruction instructing the printhead IC having the different address to change its address to a first unique address, the printhead IC's being connected to each other such that once the exception has changed its address to the first unique address, it causes one of the printhead IC's having a common address to change its address to the different address, so that when the print engine controller sends a second broadcast instruction to the different address, the printhead IC with the different address changes its address to a second unique address as well as causing one of the remaining printhead IC's having the common address to change to a different address, the process repeating until the print engine controller assigns the printhead IC's with mutually unique addresses.

In a further aspect the present invention provides a printhead IC further comprising open actuator test circuitry for selectively disabling the actuators when they receive a drive signal while comparing the resistance of the resistive heater to a predetermined threshold to assess whether the actuator is defective.

Optionally, during use feedback from the open actuator test circuitry is used to adjust the print data subsequently received by the drive circuitry.

Optionally, the drive circuitry adjusts the drive pulses sent to the nozzles in accordance with the temperature of the printing fluid within the nozzles.

Optionally, during use the drive circuitry adjusts the drive pulse profile in response to the temperature sensor output.

Optionally, during use, the temperature sensor can be deactivated after a period of use.

Optionally, the drive circuitry delays sending the drive pulses to one of the groups relative to at least one of the other groups.

Optionally, each row of nozzles is divided into a plurality of groups, each having at least one nozzle the drive circuitry delays sending the drive pulses to one of the groups relative to at least one of the other groups.

Optionally, during use the drive circuitry actuates the nozzles in the row in accordance with a firing sequence, the firing sequence enabling the nozzles in each group to eject printing fluid simultaneously, and enabling each of the groups to eject printing fluid in succession such that, the nozzles in each group are spaced from each other by at least a predetermined minimum number of nozzles and, each of the nozzles in a group is spaced from the nozzles in the subsequently enabled group by at least the predetermined minimum number of nozzles.

Optionally, the drive circuitry is configured to operate in two modes, a printing mode in which the drive pulses it generates are printing pulses, and a maintenance mode in which the drive pulses are de-clog pulses, such that, the de-clog pulse has a longer duration than the printing pulse.

Optionally, the drive circuitry extracts a clock signal from the print data transmission from the PEC.

Optionally, the drive circuitry resets itself to a known initial state in response to receiving power from a power source after a period of not receiving power from the power source.

Optionally, the drive circuitry is configured to receive the print data in any one of a plurality of different data transmission protocols.

According to an eighth aspect, the present invention provides a printhead IC comprising:

an array of nozzles;

associated drive circuitry for receiving print data and sending drive pulses of electrical energy to the array of nozzles in accordance with the print data; and, a temperature sensor connected to the drive circuitry to adjust the drive pulse profile in response to the temperature sensor output; wherein during use, the temperature sensor can be de-activated after a period of use.

A temperature sensor on each printhead IC allows the drive circuitry to adjust the drive pulses to compensate for temperature variations. However, the temperature sensor is an added power load and an additional electronic component that generates noise in the other circuits. By de-activating the sensor once the operating temperature is known, the power and noise problems created by the sensor are temporary. The temperature of the printhead IC is not likely to vary rapidly or by large amounts once it has reached its operating temperature, so it can be de-activated with a good probability that any temperature compensation to the drive pulse profile will remain correct.

Preferably, the temperature sensor periodically re-activates such that the drive circuitry can adjust the drive pulse profile if necessary. In a further preferred form, the printhead IC has a plurality of temperature sensors spaced along the array, wherein during use, one or more of the temperature sensors can be de-activated. In some embodiments, each of the plurality of temperature sensors is activated sequentially for a period of time during the print job. Optionally, the plurality of temperatures sensors are divided into two or more groups, each group being activated for a sensing period in accordance with a predetermined repeating sequence for the duration of a print job.

Preferably, each of the plurality of temperature sensors, is configured to sense the temperature a corresponding region of the array such that the drive pulse for the nozzles in one region can differs from the drive pulse for the nozzles in another region. In one embodiment, every second temperature sensor in the plurality of temperature sensors is de-activated such that the drive circuitry adjusts the drive pulse profile for the region corresponding to each activated temperature sensor and applies the same adjustment to the adjacent region where the temperature sensor is de-activated. Preferably, the drive circuitry is programmed with a series of temperature thresholds defining a set of temperature zones, each of the zones having a different pulse profile for the drive pulses sent to the nozzles in the region currently operating in that temperature zone. In a further preferred form the pulse profile for each temperature zone differs in its duration. In a particularly preferred form, the associated drive circuitry sets the pulse duration to zero if the temperature sensor indicates that region is operating at a temperature above the highest of the temperature thresholds. In some embodiments, the array is arranged into rows and columns of nozzles and each of the regions are a plurality of adjacent columns, such that the drive circuitry is configured to fire the nozzles one row at a time. In specific forms of this embodiment, the drive circuitry enables the nozzles in the row to fire in a predetermined firing sequence. In some versions of this embodiment, the associated drive circuitry sets the duration of the pulse profile to a sub ejection value for any of the nozzles in the row that are not to eject a drop during that firing sequence.

Optionally, the temperature sensor periodically re-activates such that the drive circuitry can adjust the drive pulse profile if necessary.

In a further aspect the present invention provides a printhead IC further comprising a plurality of temperature sensors spaced along the array, wherein during use, one or more of the temperature sensors can be de-activated.

Optionally, each of the plurality of temperature sensors is activated sequentially for a period of time during the print job.

Optionally, the plurality of temperatures sensors are divided into two or more groups, each group being activated for a sensing period in accordance with a predetermined repeating sequence for the duration of a print job.

Optionally, each of the plurality of temperature sensors, is configured to sense the temperature a corresponding region of the array such that the drive pulse for the nozzles in one region can differs from the drive pulse for the nozzles in another region.

Optionally, every second temperature sensor in the plurality of temperature sensors is de-activated such that the drive circuitry adjusts the drive pulse profile for the region corresponding to each activated temperature sensor and applies the same adjustment to the adjacent region where the temperature sensor is de-activated.

Optionally, the drive circuitry is programmed with a series of temperature thresholds defining a set of temperature zones, each of the zones having a different pulse profile for the drive pulses sent to the nozzles in the region currently operating in that temperature zone.

Optionally, the pulse profile for each temperature zone differs in its duration.

Optionally, the drive circuitry sets the pulse duration to zero if the temperature sensor indicates that region is operating at a temperature above the highest of the temperature thresholds.

Optionally, the array is arranged into rows and columns of nozzles and each of the regions are a plurality of adjacent columns, such that the drive circuitry is configured to fire the nozzles one row at a time.

Optionally, the drive circuitry enables the nozzles in the row to fire in a predetermined firing sequence.

Optionally, the drive circuitry sets the duration of the pulse profile to a sub ejection value for any of the nozzles in the row that are not to eject a drop during that firing sequence.

In a further aspect the present invention provides a printhead IC mounted to a pagewidth printhead with a plurality of like printhead IC's, wherein all the printhead IC's have a common initial address with one exception, the exception having a different address such that the print engine controller sends a first instruction to any printhead IC's having the different address, the first broadcast instruction instructing the printhead IC having the different address to change its address to a first unique address, the printhead IC's being connected to each other such that once the exception has changed its address to the first unique address, it causes one of the printhead IC's having a common address to change its address to the different address, so that when the print engine controller sends a second broadcast instruction to the different address, the printhead IC with the different address changes its address to a second unique address as well as causing one of the remaining printhead IC's having the common address to change to a different address, the process repeating until the print engine controller assigns the printhead IC's with mutually unique addresses.

In a further aspect the present invention provides a printhead IC comprising open actuator test circuitry for selectively disabling the actuators when they receive a drive signal while comparing the resistance of the resistive heater to a predetermined threshold to assess whether the actuator is defective.

Optionally, during use feedback from the open actuator test circuitry is used to adjust the print data subsequently received by the drive circuitry.

Optionally, the drive circuitry is configured to operate in two modes, a printing mode in which the drive pulses it generates are printing pulses, and a maintenance mode in which the drive pulses are de-clog pulses, such that, the de-clog pulse has a longer duration than the printing pulse.

Optionally, the drive circuitry extracts a clock signal from the print data transmission from the PEC.

Optionally, the drive circuitry resets itself to a known initial state in response to receiving power from a power source after a period of not receiving power from the power source.

Optionally, the drive circuitry is configured to receive the print data in any one of a plurality of different data transmission protocols.

According to a ninth aspect, the present invention provides an inkjet printer comprising:

an array of nozzles arranged into rows, each row of nozzles is divided into a plurality of groups, each having at least one nozzle; and, drive circuitry for sending a drive pulse to each of the nozzles individually such that they eject a drop of printing fluid; wherein, the drive circuitry delays sending the drive pulses to one of the groups relative to at least one of the other groups.

By firing the nozzles in stages, the rate of change of the current drawn from the power supply decreases. This in turn lowers the impedance in the circuit and therefore, the voltage sag. The minimum time available to fire all the nozzles in arrow is set by the ink refill time. In the Applicant's printhead IC designs, the ink refill can be approximately 50 microseconds. The duration of the firing pulse is about 300 to 500 nanoseconds. In a printhead IC with, say, ten rows of nozzles, each row has about 5 microseconds to fire all the nozzles. To fire the row in less time is possible but would mean the row would spend some time completely inactive in between row fires. The invention utilizes this time to stagger the nozzle firing sequence in the row and thereby smooth the increase in the current required.

Preferably, the row of nozzles is made up of a series of regions, and the sets are determined by the nozzles that are positioned within one of the regions. In a further preferred form, each row has a total time available for it to eject printing fluid from all the nozzles, and the drive pulse sent to eject printing fluid from the nozzles in one region, partially overlaps with the drive pulse sent to eject printing fluid from the nozzles of at least one other region.

Optionally, the array is made up of a series of regions, with a number of the groups from each row being within each of the regions, such that the drive circuitry starts sending the drive pulses to each of the regions sequentially.

Optionally, the drive pulses are sent to each region in a firing sequence such that only one nozzle from each group fires simultaneously, and the firing sequence for each region having the same duration such that the firing sequence from the one region, partially overlaps with more than of the firing sequences from other regions in the same row.

In a further aspect the present invention provides an inkjet printer comprising a plurality of temperature sensors positioned along the array of nozzles such that the drive circuitry adjusts the drive pulses in response to the temperature sensor outputs.

Optionally, the plurality of temperatures sensors are divided into two or more groups, each group being activated for a sensing period in accordance with a predetermined repeating sequence for the duration of a print job.

Optionally, each of the plurality of temperature sensors, is configured to sense the temperature a corresponding region of the array such that the drive pulse for the nozzles in one region can differs from the drive pulse for the nozzles in another region.

Optionally, every second temperature sensor in the plurality of temperature sensors is de-activated such that the drive circuitry adjusts the drive pulse profile for the region corresponding to each activated temperature sensor and applies the same adjustment to the adjacent region where the temperature sensor is de-activated.

Optionally, drive circuitry is programmed with a series of temperature thresholds defining a set of temperature zones, each of the zones having a different pulse profile for the drive pulses sent to the nozzles in the region currently operating in that temperature zone.

Optionally, the pulse profile for each temperature zone differs in its duration.

Optionally, the drive circuitry sets the pulse duration to zero if the temperature sensor indicates that region is operating at a temperature above the highest of the temperature thresholds.

Optionally, the array is arranged into rows and columns of nozzles and each of the regions are a plurality of adjacent columns, such that the drive circuitry is configured to fire the nozzles one row at a time.

Optionally, the drive circuitry enables the nozzles in the row to fire in a predetermined firing sequence.

Optionally, the drive circuitry sets the duration of the pulse profile to a sub ejection value for any of the nozzles in the row that are not to eject a drop during that firing sequence.

Optionally, the array of nozzles and the drive circuitry is fabricated on a printhead IC, the printhead IC being mounted to a pagewidth printhead with a plurality of like printhead IC's, wherein all the printhead IC's have a common initial address with one exception, the exception having a different address such that the print engine controller sends a first instruction to any printhead IC's having the different address, the first broadcast instruction instructing the printhead IC having the different address to change its address to a first unique address, the printhead IC's being connected to each other such that once the exception has changed its address to the first unique address, it causes one of the printhead IC's having a common address to change its address to the different address, so that when the print engine controller sends a second broadcast instruction to the different address, the printhead IC with the different address changes its address to a second unique address as well as causing one of the remaining printhead IC's having the common address to change to a different address, the process repeating until the print engine controller assigns the printhead IC's with mutually unique addresses.

In a further aspect the present invention provides an inkjet printer further comprising open actuator test circuitry for selectively disabling the actuators when they receive a drive signal while comparing the resistance of the resistive heater to a predetermined threshold to assess whether the actuator is defective.

Optionally, during use feedback from the open actuator test circuitry is used to adjust the print data subsequently received by the drive circuitry.

Optionally, the drive circuitry is configured to operate in two modes, a printing mode in which the drive pulses it generates are printing pulses, and a maintenance mode in which the drive pulses are de-clog pulses, such that, the de-clog pulse has a longer duration than the printing pulse.

Optionally, the drive circuitry extracts a clock signal from the print data transmission from the PEC.

Optionally, the drive circuitry resets itself to a known initial state in response to receiving power from a power source after a period of not receiving power from the power source.

Optionally, the drive circuitry is configured to receive the print data in any one of a plurality of different data transmission protocols.

According to a tenth aspect, the present invention provides an inkjet printer comprising:

an array of nozzles arranged into rows, each row consisting of a plurality of nozzle groups, the nozzles in each group being interspersed with nozzles from the other groups; and, associated drive circuitry for actuating the nozzles in the row in accordance with a firing sequence, the firing sequence enabling the nozzles in each group to eject printing fluid simultaneously, and enabling each of the groups to eject printing fluid in succession; wherein, the nozzles in each group are spaced from each other by at least a predetermined minimum number of nozzles and, each of the nozzles in a group is spaced from the nozzles in the subsequently enabled group by at least the predetermined minimum number of nozzles.

The invention sets the nozzle firing sequence in each row such that the nozzles fire in staggered groups, the nozzles within each group can be selected so that they are not too close to a simultaneously fired nozzle, or a nozzle that is fired immediately afterwards. Staging the nozzle firings avoids the high current required for firing the whole row simultaneously. Maintaining a minimum spacing between simultaneously fired nozzles and the nozzles fired immediately after them avoids the detrimental effects of fluidic cross talk and aerodynamic interference.

It should be noted that the print data is unlikely to require every nozzle in a row to fire in the same firing sequence. However, the invention enables every nozzle to fire at a certain time within the firing sequence, regardless of whether it does fire a drop. Therefore, the spacing between simultaneously firing nozzles, or sequentially firing nozzles, will often be more than the predetermined minimum spacing, but this is not detrimental to the print quality. The invention is concerned with ensuring the spacing between two potentially interfering drops is never less than the predetermined minimum.

Preferably, the row is divided into spans having only one nozzle from every group so that the number of spans across the row equals the number of groups of nozzles. In a further preferred form, the predetermined minimum number of nozzles between sequentially enabled nozzles is a uniform shift along each span in a uniform direction, the shift being a number of nozzles that is an integer greater than one and not a factor of the number of nozzles in the span, such that, the successively enabled nozzles in each span progress toward one end of the span until there are insufficient nozzles left at the end to fill the shift, in which case, the shift is completed with nozzles at the opposite end of the span so that all the nozzles in the span are enabled once during the firing sequence.

In a particularly preferred form, the shift is the number of nozzles that is the nearest integer to the square root of the span, that is not a factor (i.e. the span can not be divisible by the shift without a remainder). The Applicant has found that this provides a maximum spacing in time and space for ejected drops.

Optionally, the row is divided into spans having only one nozzle from every group so that the number of spans across the row equals the number of groups of nozzles.

Optionally, the predetermined minimum number of nozzles between sequentially enabled nozzles is a uniform shift along each span in a uniform direction, the shift being a number of nozzles that is an integer greater than one and not a factor of the number of nozzles in the span, such that, the successively enabled nozzles in each span progress toward one end of the span until there are insufficient nozzles left at the end to fill the shift, in which case, the shift is completed with nozzles at the opposite end of the span so that all the nozzles in the span are enabled once during the firing sequence.

Optionally, the shift is the number of nozzles that is the nearest integer to the square root of the span, that is not a factor.

In a another aspect the present invention provides an inkjet printer further comprising a plurality of temperature sensors positioned along the array of nozzles such that the drive circuitry adjusts the drive pulses in response to the temperature sensor outputs.

Optionally, each of the plurality of temperature sensors is activated sequentially for a period of time during the print job.

Optionally, the plurality of temperatures sensors are divided into two or more groups, each group being activated for a sensing period in accordance with a predetermined repeating sequence for the duration of a print job.

Optionally, each of the plurality of temperature sensors, is configured to sense the temperature a corresponding region of the array such that the drive pulse for the nozzles in one region can differs from the drive pulse for the nozzles in another region.

Optionally, every second temperature sensor in the plurality of temperature sensors is de-activated such that the drive circuitry adjusts the drive pulse profile for the region corresponding to each activated temperature sensor and applies the same adjustment to the adjacent region where the temperature sensor is de-activated.

Optionally, the drive circuitry is programmed with a series of temperature thresholds defining a set of temperature zones, each of the zones having a different pulse profile for the drive pulses sent to the nozzles in the region currently operating in that temperature zone.

Optionally, the pulse profile for each temperature zone differs in its duration.

Optionally, the drive circuitry sets the pulse duration to zero if the temperature sensor indicates that region is operating at a temperature above the highest of the temperature thresholds.

Optionally, the drive circuitry sets the duration of the pulse profile to a sub ejection value for any of the nozzles in the row that are not to eject a drop during that firing sequence.

In a further aspect the present invention provides an inkjet printer mounted to a pagewidth printhead with a plurality of like printhead IC's, wherein all the printhead IC's have a common initial address with one exception, the exception having a different address such that the print engine controller sends a first instruction to any printhead IC's having the different address, the first broadcast instruction instructing the printhead IC having the different address to change its address to a first unique address, the printhead IC's being connected to each other such that once the exception has changed its address to the first unique address, it causes one of the printhead IC's having a common address to change its address to the different address, so that when the print engine controller sends a second broadcast instruction to the different address, the printhead IC with the different address changes its address to a second unique address as well as causing one of the remaining printhead IC's having the common address to change to a different address, the process repeating until the print engine controller assigns the printhead IC's with mutually unique addresses.

In a further aspect the present invention provides an inkjet printer further comprising open actuator test circuitry for selectively disabling the actuators when they receive a drive signal while comparing the resistance of the resistive heater to a predetermined threshold to assess whether the actuator is defective.

Optionally, during use feedback from the open actuator test circuitry is used to adjust the print data subsequently received by the drive circuitry.

Optionally, the drive circuitry is configured to operate in two modes, a printing mode in which the drive pulses it generates are printing pulses, and a maintenance mode in which the drive pulses are de-clog pulses, such that, the de-clog pulse has a longer duration than the printing pulse.

Optionally, the drive circuitry extracts a clock signal from the print data transmission from the PEC.

Optionally, the drive circuitry resets itself to a known initial state in response to receiving power from a power source after a period of not receiving power from the power source.

Optionally, the drive circuitry is configured to receive the print data in any one of a plurality of different data transmission protocols.

According to an eleventh aspect, the present invention provides a printhead IC for an inkjet printer that mounts the printhead IC together with at least one other like printhead IC to provide a pagewidth printhead for printing onto a media substrate fed past the printhead in a feed direction, the printhead IC comprising:

an elongate array of nozzles, the nozzles arranged into rows, at least one of the rows having a first section positioned on a line extending perpendicular to the feed direction, a second section positioned along a parallel line displaced from the first section, and an intermediate section of nozzles extending between the first section and the second section; and, a supply conduit for providing printing fluid to the first section, the second section and the intermediate section, the supply conduit having a first portion extending perpendicular to the feed direction for supplying the first section of nozzles, a second portion extending perpendicular to the feed direction for supplying the second section of nozzles and an inclined portion for supplying the intermediate section of nozzles.

Inclining a section of the nozzle rows down to meet the drop triangle, avoids sharp corners in the corresponding supply conduit.

Preferably, the intermediate section of nozzles follows a stepped path from the first section to the section. In a further preferred form the stepped path comprises steps of two nozzles each, the two nozzles on each step being positioned on a line extending perpendicular to the feed direction. In a particularly preferred form each of the rows in the array have a first and second section extending perpendicular to the feed direction and an inclined section extending between the two. In some embodiments, the array of nozzles are fabricated on one side of a wafer substrate and the supply conduits are a series of channels etched into the opposite side of the wafer substrate. In specific embodiments, each of the supply conduits supplies printing fluid to two of the rows of nozzles.

Optionally, the intermediate section of nozzles follows a stepped path from the first section to the section.

Optionally, the stepped path comprises steps of two nozzles each, the two nozzles on each step being positioned on a line extending perpendicular to the feed direction.

Optionally, the array of nozzles are fabricated on one side of a wafer substrate and the supply conduits are a series of channels etched into the opposite side of the wafer substrate.

Optionally, each of the supply conduits supplies printing fluid to two of the rows of nozzles.

Optionally, the nozzles eject printing fluid in accordance with print data from a print engine controller, the printing fluid ejected from the intermediate section is progressively delayed with each step on the stepped path.

In another aspect the present invention provides a printhead IC further comprising a plurality of temperature sensors positioned along the array of nozzles such that the drive circuitry adjusts the drive pulses in response to the temperature sensor outputs.

Optionally, each of the plurality of temperature sensors is activated sequentially for a period of time during the print job.

Optionally, the plurality of temperatures sensors are divided into two or more groups, each group being activated for a sensing period in accordance with a predetermined repeating sequence for the duration of a print job.

Optionally, each of the plurality of temperature sensors, is configured to sense the temperature a corresponding region of the array such that the drive pulse for the nozzles in one region can differs from the drive pulse for the nozzles in another region.

Optionally, every second temperature sensor in the plurality of temperature sensors is de-activated such that the drive circuitry adjusts the drive pulse profile for the region corresponding to each activated temperature sensor and applies the same adjustment to the adjacent region where the temperature sensor is de-activated.

Optionally, the drive circuitry is programmed with a series of temperature thresholds defining a set of temperature zones, each of the zones having a different pulse profile for the drive pulses sent to the nozzles in the region currently operating in that temperature zone.

Optionally, the pulse profile for each temperature zone differs in its duration.

Optionally, the drive circuitry sets the pulse duration to zero if the temperature sensor indicates that region is operating at a temperature above the highest of the temperature thresholds.

Optionally, the drive circuitry sets the duration of the pulse profile to a sub ejection value for any of the nozzles in the row that are not to eject a drop during that firing sequence.

In another aspect the present invention provides a printhead IC mounted to a pagewidth printhead with a plurality of like printhead IC's, wherein all the printhead IC's have a common initial address with one exception, the exception having a different address such that the print engine controller sends a first instruction to any printhead IC's having the different address, the first broadcast instruction instructing the printhead IC having the different address to change its address to a first unique address, the printhead IC's being connected to each other such that once the exception has changed its address to the first unique address, it causes one of the printhead IC's having a common address to change its address to the different address, so that when the print engine controller sends a second broadcast instruction to the different address, the printhead IC with the different address changes its address to a second unique address as well as causing one of the remaining printhead IC's having the common address to change to a different address, the process repeating until the print engine controller assigns the printhead IC's with mutually unique addresses.

In another aspect the present invention provides a printhead IC further comprising open actuator test circuitry for selectively disabling the actuators when they receive a drive signal while comparing the resistance of the resistive heater to a predetermined threshold to assess whether the actuator is defective.

Optionally, during use feedback from the open actuator test circuitry is used to adjust the print data subsequently received by the drive circuitry.

Optionally, the drive circuitry is configured to operate in two modes, a printing mode in which the drive pulses it generates are printing pulses, and a maintenance mode in which the drive pulses are de-clog pulses, such that, the de-clog pulse has a longer duration than the printing pulse.

Optionally, the drive circuitry resets itself to a known initial state in response to receiving power from a power source after a period of not receiving power from the power source.

According to a twelfth aspect, the present invention provides a printhead IC comprising:

an array of nozzles, each with a corresponding heater to form a vapor bubble in printing fluid that causes a drop of the printing fluid to eject through the nozzle; and, drive circuitry for generating drive pulses that energize the heaters, the drive circuitry being configured to operate in two modes, a printing mode in which the drive pulses it generates are printing pulses, and a maintenance mode in which the drive pulses are de-clog pulses; wherein, the de-clog pulse has a longer duration than the printing pulse.

The bubble formed by a relatively long, low power pulse is a larger bubble. A larger bubble imparts a greater impulse to the ink and is therefore better able to de-clog the nozzle. The impulse is the pressure integrated over the bubble area and the pulse duration. During the printing mode, it is desirable to nucleate the bubble quickly to reduce the heat lost into the ink by conduction as the heater heats up to the superheated temperature. By lowering the pulse power, bubble nucleation is delayed. During the delay, the heater increases the heat conducted into the ink. The thermal energy of the ink rises and upon nucleation, the stored energy is released as a larger bubble with greater impulse.

Optionally, the de-clog pulse is preceded by a series of sub-ejection pulses that do not have sufficient energy to nucleate a bubble in the printing fluid.

Optionally, the drive circuitry sends de-clog pulses to at least some of the nozzles during a print job.

Optionally, the drive circuitry sends the de-clog pulses between pages of the print job.

In another aspect the present invention provides an inkjet printer further comprising a plurality of temperature sensors positioned along the array of nozzles such that the drive circuitry adjusts the drive pulses in response to the temperature sensor outputs.

Optionally, the plurality of temperatures sensors are divided into two or more groups, each group being activated for a sensing period in accordance with a predetermined repeating sequence for the duration of a print job.

Optionally, each of the plurality of temperature sensors, is configured to sense the temperature a corresponding region of the array such that the drive pulse for the nozzles in one region can differs from the drive pulse for the nozzles in another region.

Optionally, every second temperature sensor in the plurality of temperature sensors is de-activated such that the drive circuitry adjusts the drive pulse profile for the region corresponding to each activated temperature sensor and applies the same adjustment to the adjacent region where the temperature sensor is de-activated.

Optionally, the drive circuitry is programmed with a series of temperature thresholds defining a set of temperature zones, each of the zones having a different pulse profile for the drive pulses sent to the nozzles in the region currently operating in that temperature zone.

Optionally, the pulse profile for each temperature zone differs in its duration.

Optionally, the drive circuitry sets the pulse duration to zero if the temperature sensor indicates that region is operating at a temperature above the highest of the temperature thresholds.

Optionally, the array is arranged into rows and columns of nozzles and each of the regions are a plurality of adjacent columns, such that the drive circuitry is configured to fire the nozzles one row at a time.

Optionally, the drive circuitry enables the nozzles in the row to fire in a predetermined firing sequence.

Optionally, the drive circuitry sets the duration of the pulse profile to a sub ejection value for any of the nozzles in the row that are not to eject a drop during that firing sequence.

Optionally, the array of nozzles and the drive circuitry is fabricated on a printhead IC, the printhead IC being mounted to a pagewidth printhead with a plurality of like printhead IC's, wherein all the printhead IC's have a common initial address with one exception, the exception having a different address such that the print engine controller sends a first instruction to any printhead IC's having the different address, the first broadcast instruction instructing the printhead IC having the different address to change its address to a first unique address, the printhead IC's being connected to each other such that once the exception has changed its address to the first unique address, it causes one of the printhead IC's having a common address to change its address to the different address, so that when the print engine controller sends a second broadcast instruction to the different address, the printhead IC with the different address changes its address to a second unique address as well as causing one of the remaining printhead IC's having the common address to change to a different address, the process repeating until the print engine controller assigns the printhead IC's with mutually unique addresses.

In another aspect the present invention provides a printhead IC further comprising open actuator test circuitry for selectively disabling the actuators when they receive a drive signal while comparing the resistance of the resistive heater to a predetermined threshold to assess whether the actuator is defective.

Optionally, during use feedback from the open actuator test circuitry is used to adjust the print data subsequently received by the drive circuitry.

Optionally, the drive circuitry extracts a clock signal from the print data transmission from the PEC.

Optionally, the drive circuitry resets itself to a known initial state in response to receiving power from a power source after a period of not receiving power from the power source.

Optionally, the drive circuitry is configured to receive the print data in any one of a plurality of different data transmission protocols.

According to a thirteenth aspect, the present invention provides a printhead IC for an inkjet printer, the inkjet printer having a PEC for sending print data to the printhead IC, the printhead IC comprising:

an array of nozzles for ejecting drops of printing fluid onto a media substrate; and, drive circuitry for driving the array of nozzles, the drive circuitry being configured for connection to a power source in the printer; wherein, the drive circuitry being configured to reset itself to a known initial state in response to receiving power from the power source after a period of not receiving power from the power source.

By initializing the printhead IC's in response to power up, the PEC/printhead IC's interface does not need a separate reset line connected to each of the IC's. In fact, the PEC can have as little as two electrical connections. There is no need to initialize the printhead IC's using. A 'data in' from the PEC to the printhead IC's and a 'data out' line from the printhead IC's back to the PEC are the only connections required if the print data is sent via a self clocking data signal. If the data in signal is not self clocking, it will need to have a clock line through the PEC/printhead IC interface.

Optionally, the drive circuitry is configured to extract a clock signal from the data transmission from the PEC.

Optionally, the data transmission is a digital signal that has a rising edge at every clock period.

Optionally, the drive circuitry determines a data bit from every clock period by the position of the falling edge during that period.

In another aspect the present invention provides a printhead IC linked with other like printhead IC's to form a pagewidth printhead, wherein the data transmission is multidropped to all the printhead IC's and each printhead IC has a unique write address provided by the PEC.

In another aspect the present invention provides a printhead IC further comprising a plurality of temperature sensors positioned along the array of nozzles such that the drive circuitry adjusts the drive pulses in response to the temperature sensor outputs.

Optionally, each of the plurality of temperature sensors is activated sequentially for a period of time during the print job.

Optionally, the plurality of temperatures sensors are divided into two or more groups, each group being activated for a sensing period in accordance with a predetermined repeating sequence for the duration of a print job.

Optionally, each of the plurality of temperature sensors, is configured to sense the temperature a corresponding region of the array such that the drive pulse for the nozzles in one region can differs from the drive pulse for the nozzles in another region.

Optionally, every second temperature sensor in the plurality of temperature sensors is de-activated such that the drive circuitry adjusts the drive pulse profile for the region corresponding to each activated temperature sensor and applies the same adjustment to the adjacent region where the temperature sensor is de-activated.

Optionally, the drive circuitry is programmed with a series of temperature thresholds defining a set of temperature zones, each of the zones having a different pulse profile for the drive pulses sent to the nozzles in the region currently operating in that temperature zone.

Optionally, the pulse profile for each temperature zone differs in its duration.

Optionally, the drive circuitry sets the pulse duration to zero if the temperature sensor indicates that region is operating at a temperature above the highest of the temperature thresholds.

Optionally, the drive circuitry sets the duration of the pulse profile to a sub ejection value for any of the nozzles in the row that are not to eject a drop during that firing sequence.

In another aspect the present invention provides a printhead IC mounted to a pagewidth printhead with a plurality of like printhead IC's, wherein all the printhead IC's have a common initial address with one exception, the exception having a different address such that the print engine controller sends a first instruction to any printhead IC's having the different address, the first broadcast instruction instructing the printhead IC having the different address to change its address to a first unique address, the printhead IC's being connected to each other such that once the exception has changed its address to the first unique address, it causes one of the printhead IC's having a common address to change its address to the different address, so that when the print engine controller sends a second broadcast instruction to the different address, the printhead IC with the different address changes its address to a second unique address as well as causing one of the remaining printhead IC's having the common address to change to a different address, the process repeating until the print engine controller assigns the printhead IC's with mutually unique addresses.

In another aspect the present invention provides a printhead IC comprising open actuator test circuitry for selectively disabling the actuators when they receive a drive signal while comparing the resistance of the resistive heater to a predetermined threshold to assess whether the actuator is defective.

Optionally, during use feedback from the open actuator test circuitry is used to adjust the print data subsequently received by the drive circuitry.

Optionally, the drive circuitry is configured to operate in two modes, a printing mode in which the drive pulses it generates are printing pulses, and a maintenance mode in which the drive pulses are de-clog pulses, such that, the de-clog pulse has a longer duration than the printing pulse.

Optionally, the interface between the printhead and the PEC has only two connections.

Optionally, the drive circuitry is configured to receive the print data in any one of a plurality of different data transmission protocols.

According to a fourteenth aspect, the present invention provides a printhead IC for an inkjet printer, the inkjet printer having a PEC for sending print data to the printhead IC in accordance with a predetermined data transmission protocol, the printhead IC comprising:

an array of nozzles for ejecting drops of printing fluid onto a media substrate; and, drive circuitry for driving the array of nozzles; wherein, the circuitry is configured to receive print data in any one of a plurality of different data transmission protocols.

Making the printhead IC's compatible with different data transmission protocols increases the versatility of the printhead IC design. A versatile design lowers the types of chip that need to be fabricated thereby lowering production costs.

Optionally, one of the data transmission protocols is a self clocking data signal and another data transmission protocol has separate clock and data signals.

Optionally, connection to a power source within the printer, the drive circuitry cycles through different operating modes until it aligns with the data transmission protocol being used by the PEC.

Optionally, the drive circuitry is configured to extract a clock signal from the data transmission from the PEC.

Optionally, the data transmission is a digital signal that has a rising edge at every clock period.

Optionally, the drive circuitry determines a data bit from every clock period by the position of the falling edge during that period.

In another aspect the present invention provides a printhead IC linked with other like printhead IC's to form a pagewidth printhead, wherein the data transmission is multidropped to all the printhead IC's and each printhead IC has a unique write address provided by the PEC.

Optionally, the interface between the printhead and the PEC has only two connections.

In another aspect the present invention provides a printhead IC further comprising open actuator test circuitry for selectively disabling the actuators when they receive a drive signal while comparing the resistance of the resistive heater to a predetermined threshold to assess whether the actuator is defective.

Optionally, during use feedback from the open actuator test circuitry is used to adjust the print data subsequently received by the drive circuitry.

Optionally, the open actuator test circuitry generates defective nozzle feedback during print jobs.

Optionally, the open actuator test circuitry generates defective nozzle feedback within a predetermined time period after printhead operation.

Optionally, the drive circuitry has a drive FET controlling current to the resistive heater and logic for enabling the drive FET when a drive signal is received and disabling the drive FET when a drive signal and a open actuator test signal are received.

Optionally, the drive circuitry has a bleed FET that slowly drains any voltage drop across the resistive heater to zero when the drive circuitry is not receiving a drive signal or an open actuator test signal.

Optionally, the drive circuitry has a sense node between the drain of the drive FET and the resistive heater, and the open actuator test circuitry has a sense FET that is enabled when open actuator test signal is received such that the voltage at the drain of the sense FET is used to indicate whether the heater element is defective.

Optionally, the drive FET is a p-type FET.

Optionally, the drive circuitry receives the print data for the array in a plurality of sequential portions with a fire command at the end of each portion.

In another aspect the present invention provides a printhead IC further comprising a plurality of temperature sensors positioned along the array of nozzles such that the drive circuitry adjusts the drive pulses in response to the temperature sensor outputs.

Optionally, the drive circuitry blocks the dive pulses sent to at least some of the nozzles in the array when one or more of the temperature sensors indicate the temperature exceeds a predetermined maximum.

Optionally, the drive circuitry is configured to operate in two modes, a printing mode in which the drive pulses it generates are printing pulses, and a maintenance mode in which the drive pulses are de-clog pulses, such that, the de-clog pulse has a longer duration than the printing pulse.

According to a fifteenth aspect, the present invention provides an inkjet printer comprising:

a pagewidth printhead with a plurality of printhead IC's, each having an array of nozzles for ejecting drops of printing fluid onto a media substrate, and associated drive circuitry for driving the array of nozzles;

a print engine controller for sending print data to the printhead IC's;

an interface for electrical communication between the print engine controller and the printhead IC's; wherein, all the printhead IC's have a common initial address with one exception, the exception having a different address such that the print engine controller sends a first instruction to any printhead IC's having the different address, the first broadcast instruction instructing the printhead IC having the different address to change its address to a first unique address, the printhead IC's being connected to each other such that once the exception has changed its address to the first unique address, it causes one of the printhead IC's having a common address to change its address to the different address, so that when the print engine controller sends a second broadcast instruction to the different address, the printhead IC with the different address changes its address to a second unique address as well as causing one of the remaining printhead IC's having the common address to change to a different address, the process repeating until the print engine controller assigns the printhead IC's with mutually unique addresses.

Using this process, there only needs to be two electrical connections between the print engine controller and all the printhead IC's. A 'data in' from the PEC to the printhead IC's and a 'data out' line from the printhead IC's back to the PEC.

According to a second aspect, the present invention provides a printhead cartridge for an inkjet printer having a PEC for sending print data to the printhead cartridge, the printhead cartridge comprising:

a plurality of printhead IC's, each having an array of nozzles for ejecting drops of printing fluid onto a media substrate, the printhead IC's having a common initial address with one exception that has a different address;

write address circuitry for setting the exception to the different address and providing connections between the printhead IC's so that each has its address changed from the initial address to the different address when its adjacent printhead IC has its write address changed by the PEC; and, an electrical interface for establishing two electrical connections with the PEC.

Optionally, the print data signal from the PEC is multidropped to the printhead IC's using the unique write addresses.

Optionally, the print data signal is self clocking.

Optionally, the drive circuitry is configured to extract a clock signal from the data transmission from the PEC.

Optionally, the data transmission is a digital signal that has a rising edge at every clock period.

Optionally, the drive circuitry determines a data bit from every clock period by the position of the falling edge during that period.

Optionally, the interface between the printhead and the PEC has only two connections.

Optionally, the drive circuitry is programmed with a series of temperature thresholds defining a set of temperature zones, each of the zones having a different pulse profile for the drive pulses sent to the nozzles in the region currently operating in that temperature zone.

Optionally, the pulse profile for each temperature zone differs in its duration.

Optionally, the drive circuitry sets the pulse duration to zero if the temperature sensor indicates that region is operating at a temperature above the highest of the temperature thresholds.

Optionally, the array is arranged into rows and columns of nozzles and each of the regions are a plurality of adjacent columns, such that the drive circuitry is configured to fire the nozzles one row at a time.

Optionally, the drive circuitry enables the nozzles in the row to fire in a predetermined firing sequence.

Optionally, the drive circuitry sets the duration of the pulse profile to a sub ejection value for any of the nozzles in the row that are not to eject a drop during that firing sequence.

In another aspect the present invention provides a printhead IC further comprising a plurality of temperature sensors positioned along the array of nozzles such that the drive circuitry adjusts the drive pulses in response to the temperature sensor outputs.

Optionally, each of the plurality of temperature sensors is activated sequentially for a period of time during the print job.

Optionally, the plurality of temperatures sensors are divided into two or more groups, each group being activated for a sensing period in accordance with a predetermined repeating sequence for the duration of a print job.

Optionally, each of the plurality of temperature sensors, is configured to sense the temperature a corresponding region of the array such that the drive pulse for the nozzles in one region can differs from the drive pulse for the nozzles in another region.

Optionally, every second temperature sensor in the plurality of temperature sensors is de-activated such that the drive circuitry adjusts the drive pulse profile for the region corresponding to each activated temperature sensor and applies the same adjustment to the adjacent region where the temperature sensor is de-activated.

Optionally, the drive circuitry is programmed with a series of temperature thresholds defining a set of temperature zones, each of the zones having a different pulse profile for the drive pulses sent to the nozzles in the region currently operating in that temperature zone.

Optionally, the pulse profile for each temperature zone differs in its duration.

BRIEF DESCRIPTION OF THE DRAWINGS

Specific embodiments of the invention will now be described by way of example only with reference to the accompanying drawings, in which.

DETAILED DESCRIPTION OF THE PREFERRED EMBODIMENTS

The Applicant has developed a range of printhead devices that use a series of printhead integrated circuits (ICs) that link together to form a pagewidth printhead. In this way, the printhead IC's can be assembled into printheads used in applications ranging from wide format printing to cameras and cellphones with inbuilt printers. One of the more recent printhead IC's developed by the Applicant is referred to internally as wide range of printing applications. The Applicant refers to these printhead IC's as 'Udon' and the various aspects of the invention will be described with particular reference to these printhead IC's. However, it will be appreciated that this is purely for the purposes of illustration and in no way limiting to the scope and application of the invention.

Overview

The Udon printhead IC is designed to work with other Udon ICs to make a linking printhead. The Applicant has developed a range of linking printheads in which a series of the printhead IC's are mounted end-to-end on a support member to form a pagewidth printhead. The support member mounts the printhead IC's in the printer and also distributes ink to the individual IC's. An example of this type of printhead is described in U.S. Ser. No. 11/293,820, the disclosure of which is incorporated herein by cross reference.

It will be appreciated that any reference to the term 'ink' is to be interpreted as any printing fluid unless it is clear from the context that it is only a colorant for imaging print media. The printhead IC's can equally eject invisible inks, adhesives, medicaments or other functionalized fluids.

Figure 1:
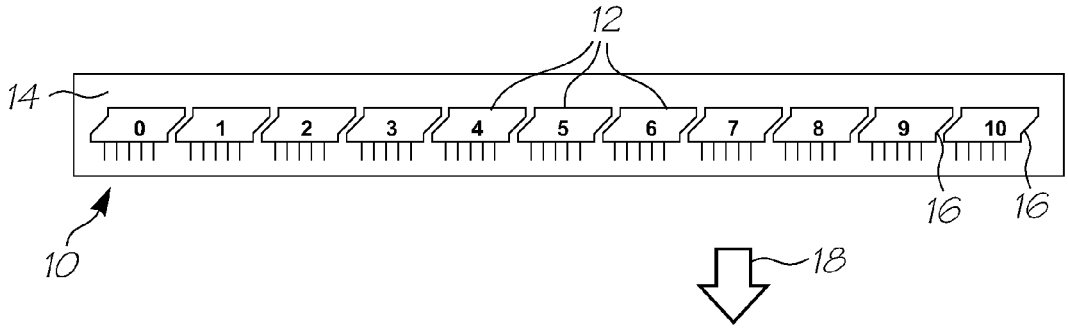
FIG. 1 is a schematic representation of the linking printhead IC construction.

FIG. 1 shows a sketch of a pagewidth printhead 10 with the series of Udon printhead ICs 12 mounted to a support member 14. The angled sides 16 allow the nozzles from one of the IC's 12 overlap with those of an adjacent IC in the paper feed direction 18. Overlapping the nozzles in each IC 12 provides continuous printing across the junction between two IC's. This avoids any 'banding' in the resulting print. Linking individual printhead IC's in this manner allows printheads of any desired length to be made by simply using different numbers of IC's.

Figure 3:
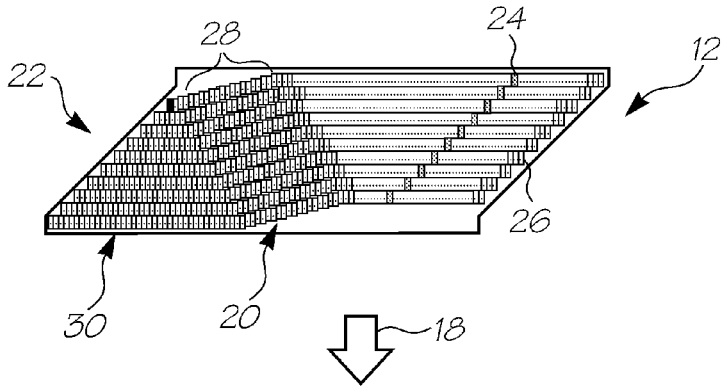
FIG. 3 shows the configuration of the nozzle array on a printhead IC.

The printhead IC's 12 are integrated CMOS and MEMS 'chips'. FIG. 3 shows the configuration of MEMS nozzles 20 on the ink ejection side of the printhead IC 12. The nozzles 20 are arranged into rows 26 and columns 24 to form a parallelogram array 22 with 'kinked' or inclined portion 28. The columns 24 are not aligned with the paper feed direction 18 because the sides of the array 22 are angled approximately 45° for the purposes of linking with adjacent IC's. The columns 24 follow this incline. The rows 26 are perpendicular to the paper feed direction except for a sloped section 28 inclined towards a 'drop triangle' 30 which has the nozzles 20 that overlap the adjacent printhead IC. This is discussed in more detail below.

Figure 2:
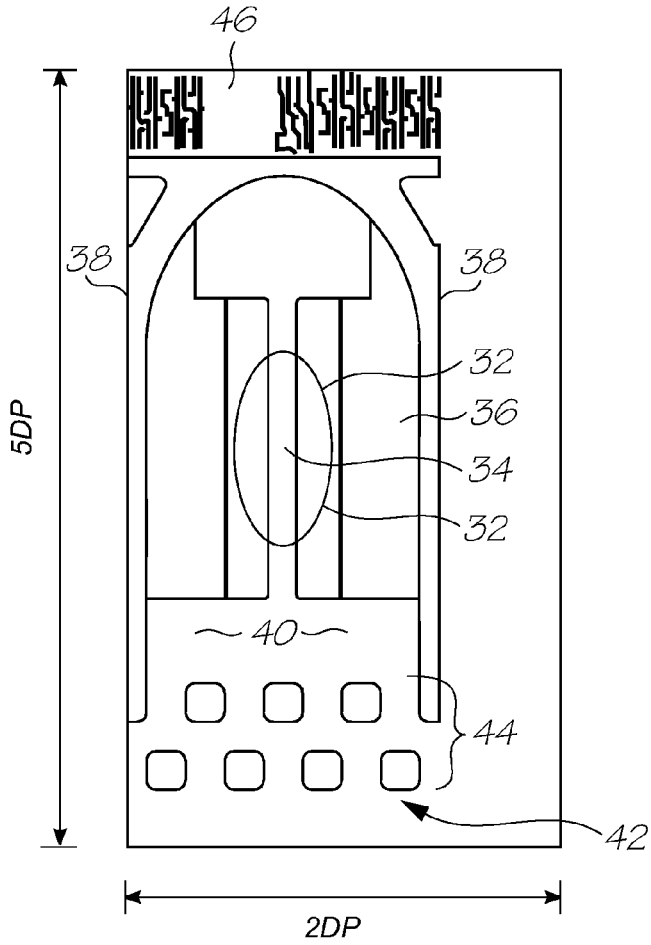
FIG. 2 is a schematic representation of the unit cell.

FIG. 2 shows the elements of a single MEMS nozzle device 20 or 'unit cell'. The construction of the unit cell 20 is discussed in detail in U.S. Ser. No. 11/246,687, the contents of which is incorporated herein by cross reference. Briefly, FIG. 2 shows the unit cell as if the nozzle plate (the outer surface of the printhead) were transparent to expose the interior features. The nozzle 32 is the ejection aperture through which the ink is ejected. The heater 34 is positioned in the nozzle chamber 36 to generate a vapour bubble that ejects a drop of ink through the nozzle 32. The U-shaped sidewall 38 defines the edges of the chamber 36. Ink enters the chamber 36 through the inlet 42 which has two rows of column features 44 that baffle pressure pulses in the ink to stop cross talk between unit cells. The CMOS layer defines the drive circuitry and has a drive FET 40 for the heater 34 and logic 46 for pulse timing and profiling. This is discussed in more detail below.

Ink is supplied to the unit cells 20 from channels in the opposite side of the wafer substrate of the printhead IC. These are described below with reference to FIG. 5C. The channels in the 'back side' of the printhead IC 12 are in fluid communication with the unit cells 20 on the front side via deep etched conduits (not shown) through the CMOS layer.

Figure 4:
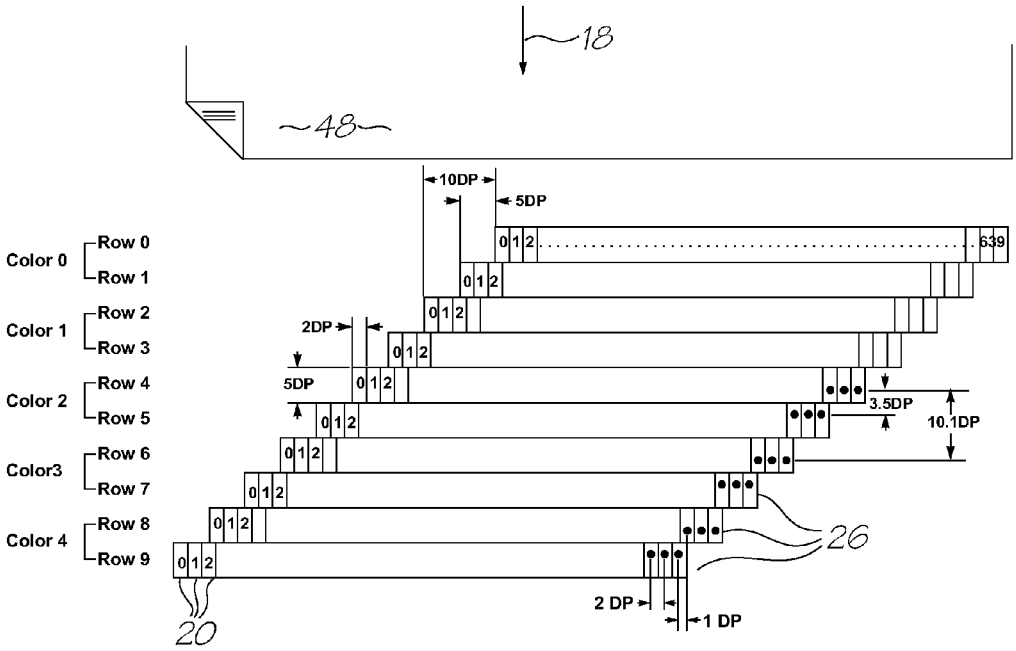
FIG. 4 is a schematic representation of the column and row positioning of the nozzles in the array.

Separate linking printhead ICs 12 are bonded to the support member 14 so that there are no printed artifacts across the join between neighbouring printhead IC's. Each IC 12 contains ten rows 26 of nozzles 32. As shown in FIG. 4, there are two adjacent rows 26 for each color to allow up to five separate types of ink. Each pair of rows 26 shares a common ink supply channel in the back side of the wafer substrate.

There are 640 nozzles per row and 2×640=1280 nozzles per color channel, which equates to 5×1280=6400 nozzles per IC 12. An A4/Letter width printhead requires a series of eleven printhead IC's (see for example FIG. 1), making the total nozzle count for the assembled printhead 11×6400=70 400 nozzles.

Color and Nozzle Arrangement

Figure 5A:
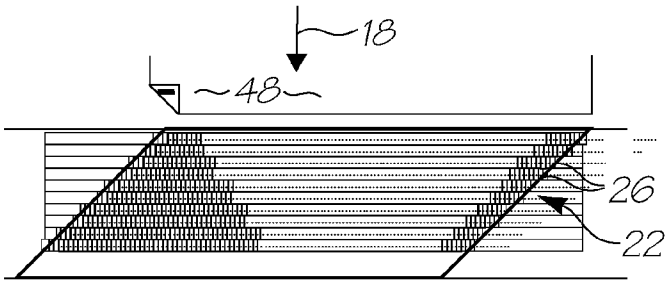
FIG. 5A is a schematic representation of the non-distorted array of nozzles.

At 1600 dpi, the distance between printed dots needs to be 15.875 m. This is referred to as the dot pitch (DP). The unit cell 20 has a rectangular footprint that is 2DP wide by 5DP long. To achieve 1600 dpi per color, the rows 26 are offset from each other relative to the feed direction 18 of the paper 48 as best shown in FIG. 4. FIG. 5A shows the parallelogram that the nozzle forms by offsetting each subsequent row 26 by 5 DP.

Linking Nozzle Arrangement

Figure 5B:
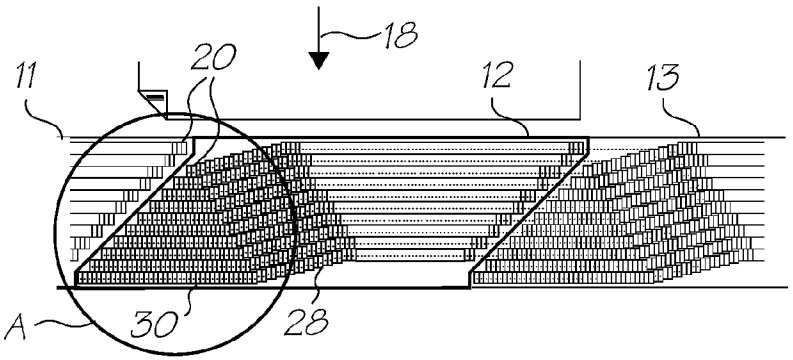
FIG. 5B is a schematic representation of the distortion of the array for continuity with adjacent printhead IC's.

The parallelogram 50 does not allow the array 22 to link with those of adjacent printhead IC's. To maintain a constant dot pitch between the edge nozzles of one printhead IC and the opposing edge nozzles of the adjacent IC, the parallelogram 50 needs to be slightly distorted. FIG. 5B shows the distortion used by the Udon design. A portion 30 of the array 22 is displaced or 'dropped' relative to the rest of the array with respect to the paper feed direction 18. For convenience, the Applicant refers to this portion as the drop triangle 30. The unit cells 20 on the outer edge of the drop triangle 30 are directly adjacent the unit cells 20 at the edge of the adjacent printhead IC 11 in terms of their dot pitch. In this way, the separate nozzle arrays link together as if they were a single continuous array.

The 'drop' of the drop triangle 30 is 10 DP. Dots printed by the nozzles in the triangle 30 are delayed by ten 'line times' (the line time is the time taken to print one line from the printhead IC, that is fire all ten rows in accordance with the print data at that point in the print job) to match the triangle offset. There is a transition zone 28 between the drop triangle 30 and the rest of the array 22. In this zone the rows 26 'droop' towards the drop triangle 30. Nine pairs of unit cells 20 sequentially drop by one line time (1 DP, 1 row time) at a time to gradually bridge the gap between dropped and normal nozzles.

Figure 5C:
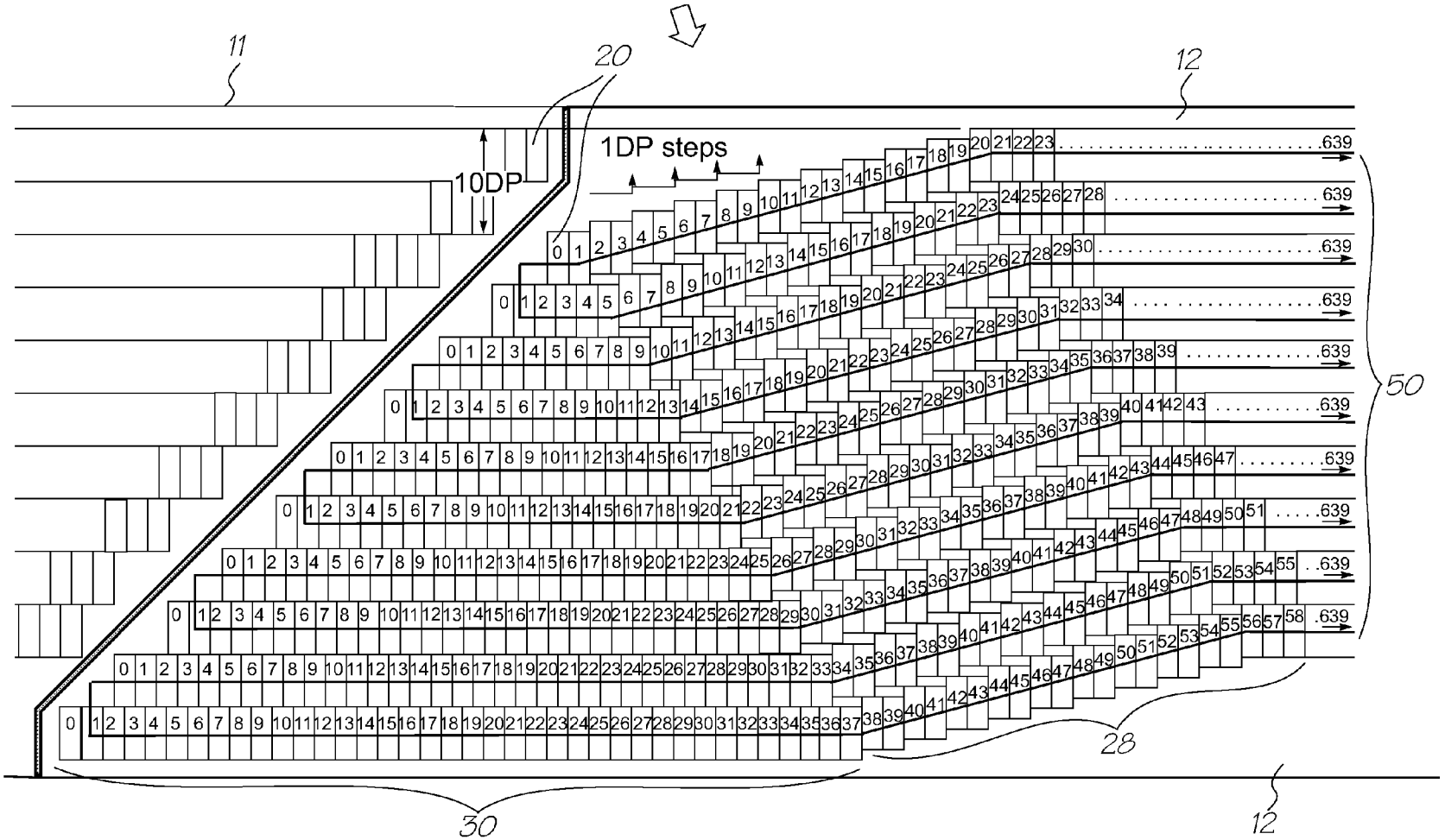
FIG. 5C is an enlarged view of the sloped section of the array with the ink supply channels overlaid.
Figure 6A:
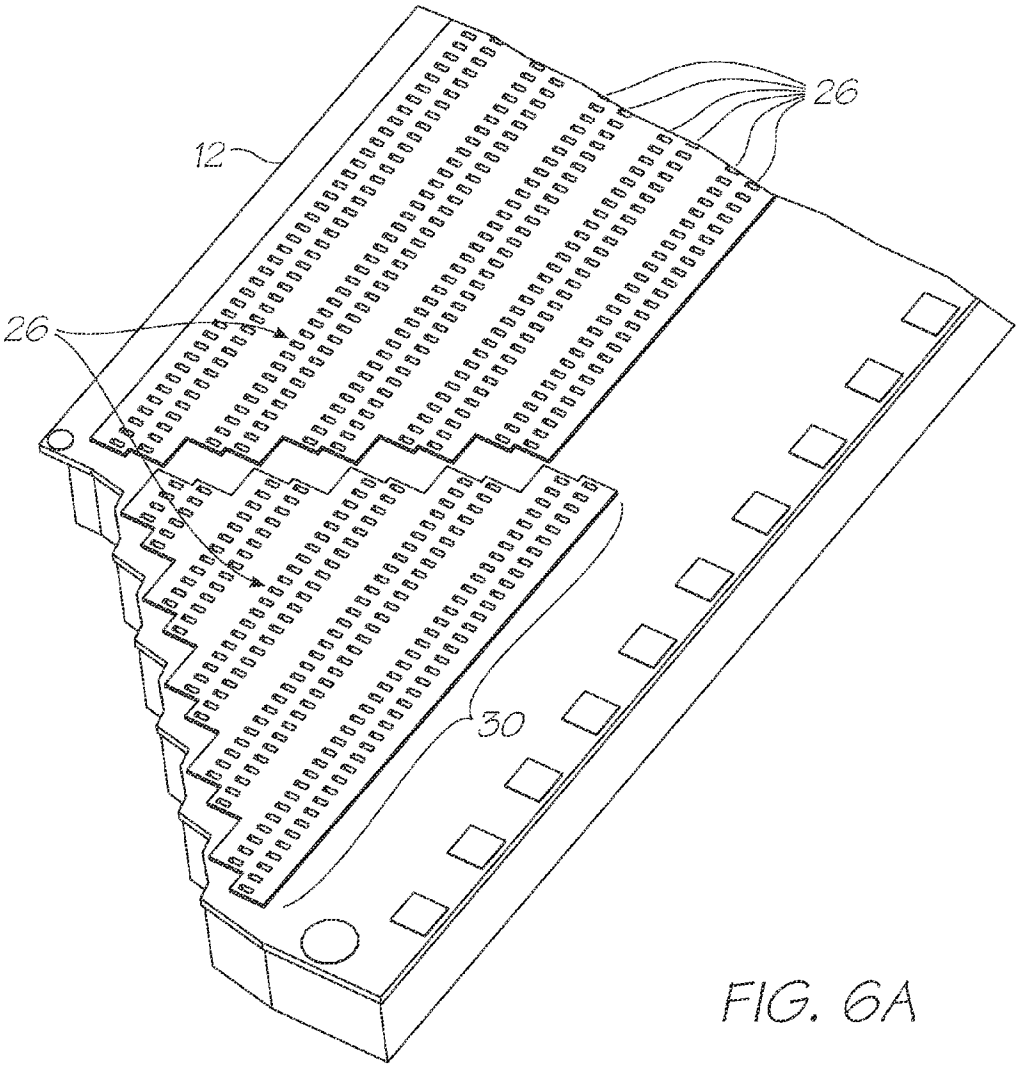
FIG. 6A shows the prior art configuration of a linking printhead IC with drop triangle.
Figure 6B:
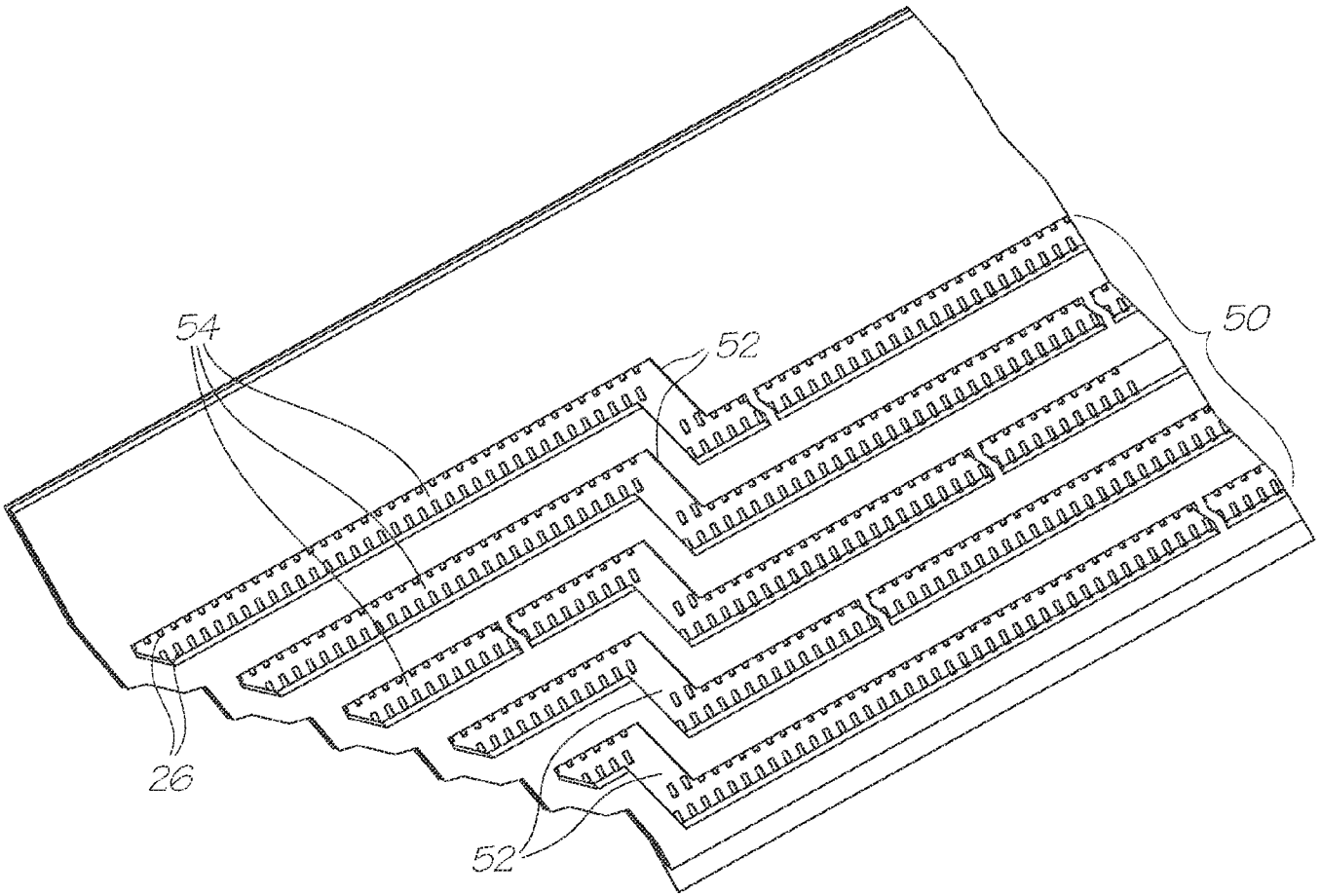
FIG. 6B (Prior Art)
FIG. 6B shows the ink supply channels corresponding to the nozzle array shown in FIG. 6A.

The droop zone is purely for linking and not necessary from a printing point of view. As shown in FIG. 6A, the rows 26 could simply terminate 10 DP above the corresponding row in the drop triangle 30. However, this creates a sharp corner in the ink supply channels 50 in the back of the IC 12 (see FIG. 6B). The sharp change of direction in the ink flow is problematic because outgassing bubbles can become lodged and difficult to remove from stagnation areas 54 at the corners 52. FIG. 5C shows the configuration of the ink supply channels 50 in the back of an Udon printhead IC 12. It can be seen that the droop zone 28 keeps the ink supply channels 50 less angled and therefore free of flow stagnation areas.

Compatibility with Different Print Engine Controllers

The Udon printhead IC, can operate in different modes depending on the print engine controller (PEC) from which it is receiving its print data. Specifically, Udon runs in two distinct modes—SoPEC mode and MoPEC mode. SoPEC is the PEC that the Applicant uses in its SOHO (small office, home office) printers, and MoPEC is the PEC used in its mobile telecommunications (e.g. cell phone or PDA) printers. Udon does not use any type of adaptor or intermediate interface to connect to differing PEC's. Instead, Udon determines the correct operating mode (SoPEC or MoPEC) when it powers up. In each mode, the contacts on each of the printhead IC's assume different functions.

SoPEC Mode Connection

Figure 7:
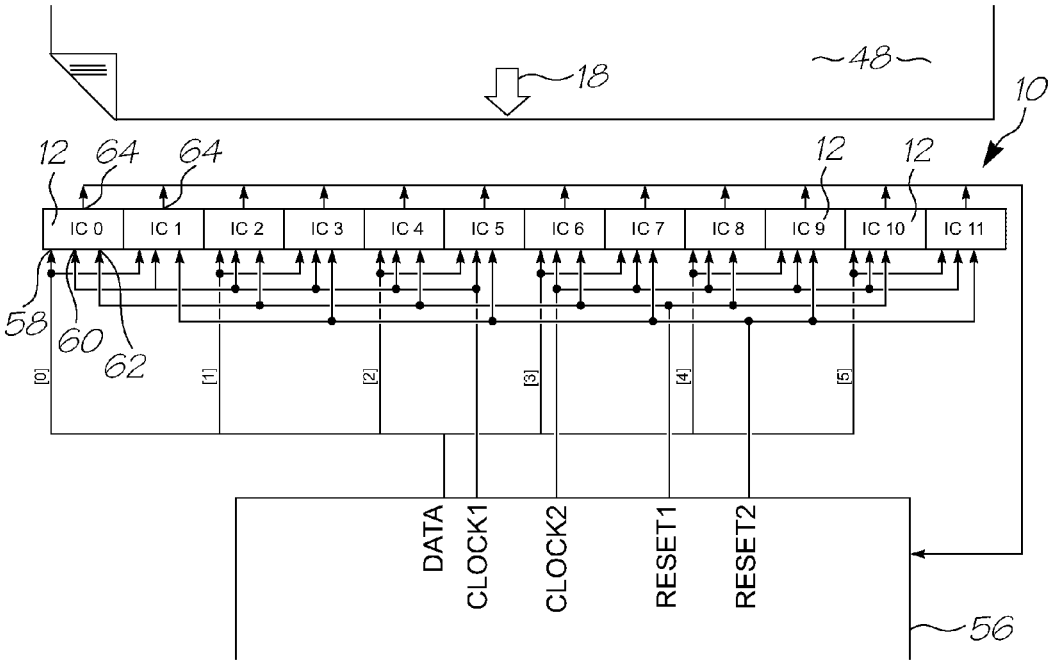
FIG. 7 is a schematic representation of the printhead connection to SoPEC.

FIG. 7 is a schematic representation of the connection of the Udon IC's 12 to a SoPEC 56. Each of the printhead IC's 12 has a clock input 60, a data input 58, a reset pin 62 and a data out pin 64. The clock and data inputs are each 2 LVDS (low voltage differential signalling) receivers with no termination. The reset pin 62 is a 3.3V Schmitt trigger that puts all control registers into a known state and disables printing. Nozzle firing is disabled combinatorially and three consecutive clocked samples are required to reset the registers. The data output pin 64 is a general purpose output but is usually used to read register values back from the printhead IC 12 to the SoPEC 56. The interface between SoPEC 56 and the printhead 10 has six connections.

MoPEC Mode Connection

Figure 8:
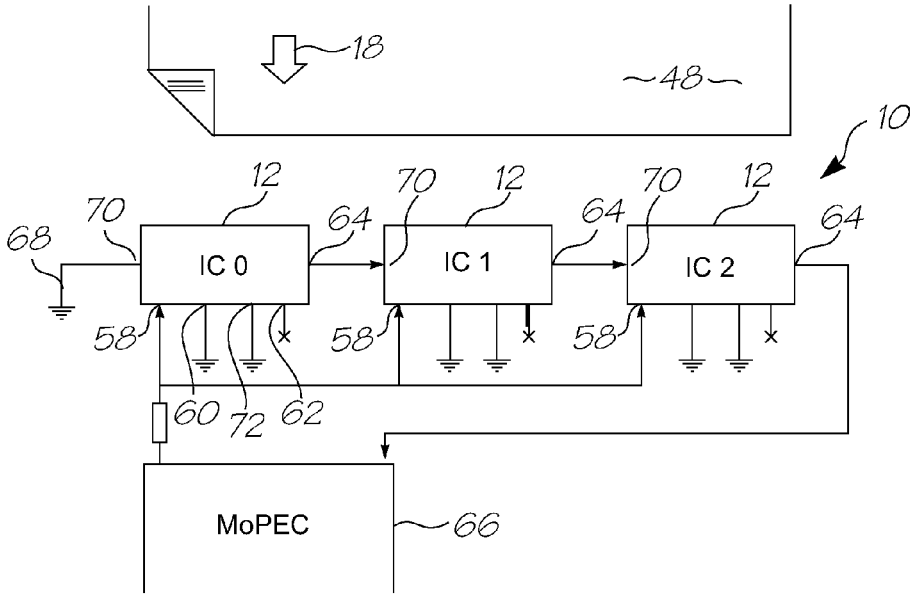
FIG. 8 is a schematic representation of the printhead connection to MoPEC.

FIG. 8 shows the connection between a MoPEC 66 and the printhead IC's 12 of a printhead 10 installed in a mobile device. Some of the same connection pins are used when the IC operates in the MoPEC mode. However, as the MoPEC printheads 10 will be physically smaller (only three chips wide for printing onto business card sized media) and more frequently replaced by the user, it is necessary to simplify the interface between the MoPEC and the printhead as much as possible. This reduces the scope for incorrect installation and enhances the intuitive usability of the mobile device.

The address carry in (ACI) 70 is the positive pin of the LVDS pair of clock input 60 in the SoPEC mode. The first printhead IC 12 in the series has the ACI 70 set to ground 68 for addressing purposes described further below. The negative pin 60 is grounded to hold it to '0' voltage. The data out pin 64 connects directly to the ACI 70 of the adjacent printhead IC 12. All the IC's 12 are daisy-chained together in this manner with the last printhead IC 12 in the series having the data out 64 connected back to the MoPEC 66.

In MoPEC mode, the reset pin 62 remains unconnected and the negative pin 72 of the data LVDS pair is grounded. The data and clock are inputted through a single connection using the self-clocking data signal discussed below. The daisy-chained connection of the IC's 12 and the self clocking data input 58 reduce the number of connections between MoPEC and the printhead to just two. This simplifies the printhead cartridge replacement process for the user and reduces the chance of incorrect installation.

Combined Clock and Data

Figure 9:
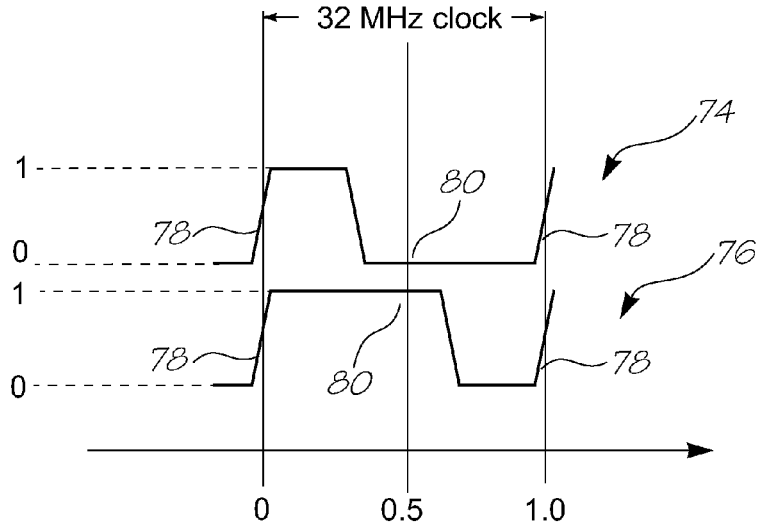
FIG. 9 show self clocking data signals for a '1' bit and a '0' bit.

The combined clock and data 58 is a pulse width modulated signal as shown in FIG. 9. The signal 74 shows one clock period and a '0' bit and the signal 76 shows one clock period and a '1' bit. The Udon IC's 12 (when in MoPEC mode) takes its clock from every rising edge 78 as the signal switches from low to high (0 to 1). Accordingly, the signal has a rising edge 78 at every period. A '0' bit drops the signal back to '0' at ⅓ of the clock period. A '1' bit drops the signal to '0' at ⅔ of the clock period. The IC looks to the state of the signal at the mid point 80 of the period to read the '0' or the '1' bit.

External Printhead IC Addressing

Each of the printhead IC's 12 are given a write address when connected to the MoPEC 66. To do this using a two wire connection between the PEC and the printhead requires an iterative process of broadcast addressing to each device individually. Udon achieves this by daisy-chaining the data output or one IC to the address carry in of the next IC. The default or reset value at the data output 64 is high or '1'. Therefore every printhead IC 12 has a '1' address except the first printhead IC 12 which has its address pulled to '0' by its connection to ground 68. To give the IC's 12 unique write addresses, the MoPEC 66 sends a broadcast command to all devices with a '0' address. In response to the broadcast command, the only IC with a '0' address, re-writes its write address to a unique address specified by MoPEC and sets its data out 64 to '0'. That in turn pulls the ACI 70 of the second IC 12 in the series to '0' so that when MoPEC again sends a broadcast command to write address '0' so that the second IC, and only the second IC, rewrites its address to a new and unique address, as well as setting its data output to '0'.

The process repeats until all the printhead IC's 12 have mutually unique write addresses and the last IC sends a '0' back to MoPEC 66. Using this system for addressing the IC's at start up, the interface need only have a connection for a combined data and clock 'multi-dropped' (connected in parallel) to all devices and a data out from the IC's back to MoPEC. As discussed above, a simplified electrical interface between the PEC and printhead cartridge enhances the ease and convenience of cartridge replacement.

Power On Reset

Udon printhead IC's 12 have a power on reset (POR) circuit. The ability to self initialize to a known state allows the printhead IC to operate in the MoPEC mode with only two contacts at the PEC/printhead 10 interface.

The POR circuit is implemented as a bidirectional reset pin 62 (see FIG. 7). The POR circuit always drives out the reset pin 62, and the IC listens to the reset pin input side. This allows SoPEC 56 to overdrive reset when required.

PEC Interface Type Detection

On power up, the Udon printhead IC 12 switches from mode to mode and suppresses fire commands until it determines the type of PEC to which it is connected. Once it selects the correct operating mode for the PEC, it will not try to align with another PEC type again until a software reset or power down/power up cycle.

An Udon printhead IC 12 can be in three interface modes:

- SoPEC mode, where both clock and data 58 are LVDS (low voltage differential signalling) contacts pairs (see FIGS. 7 and 8);
- MoPEC single-ended mode, where clock and data are combined 58 and single ended (see FIG. 8) because the data is pulse width modulated along the clock signal; and,
- MoPEC LVDS mode, where the clock 60 is single ended and data 58 is LVDS (this mode can be used if there are EMI issues).

Udon spends sufficient time in each state to align, then moves on in order if alignment is not achieved.

Multi-Stage Print Data Loading

In previous printhead IC designs, each unit cell had a shift register for the print data. Print data for the entire nozzle array was loaded and then, after the fire command from the PEC, the nozzles are fired in a predetermined sequence for that line of print. The shift register occupies valuable space in the unit cell which could be better used for a bigger, more powerful drive FET. A more powerful drive FET can provide the actuator (thermal or thermal bend actuator) with a drive pulse of sufficient energy (about 200 nJ) in a shorter time.

A bigger more powerful FET has many benefits, particularly for thermally actuated printheads. Less power is converted to wasteful heat in the FET itself, and more power is delivered to the heater. Increasing the power delivered to the heater causes the heater surface to reach the ink nucleation temperature more quickly, allowing a shorter drive pulse. The reduced drive pulse allows less time for heat diffusion from the heater into regions surrounding the heater, so the total energy required to reach the nucleation temperature is reduced. A shorter drive pulse duration also provides more scope to sequence to the nozzle firings within a single row time (the time to fire a row of nozzles).

Moving the print data shift registers out of the unit cells makes room for bigger drive FETs. However, it substantially increases the wafer area needed for the IC. The nozzle array would need an adjacent shift register array. The connections between each register and its corresponding nozzle would be relatively long contributing to greater resistive losses. This is also detrimental to efficiency.

As an effective compromise, the Udon printhead IC stages the loading and firing of the print data from the nozzle array. Print data for a first portion of the nozzle array is loaded to registers outside the array of nozzles. The PEC sends a fire command after the registers are loaded. The registers send the data to the corresponding nozzles within the first portion where they fire in accordance to the fire sequence (discussed below). While the nozzles in the first portion fire, the registers are loaded with the print data for the next portion of the array. This system removes the register from the unit cell to make way for a larger, more powerful drive FET. However, as there are only enough registers for the nozzles in a portion of the array, the resistive losses in the connection between register and nozzle is not excessive.

The drive logic on the IC 12 sends the print data to the array row by row. The nozzle array has rows of 640 nozzles in 10 rows. Adjacent to the array, 640 registers store the data for one row. The data is sent to the registers from the PEC in a predetermined row firing sequence. Previously, when the data for the entire array was loaded at once, the PEC could simply send the data for each row sequentially—row 0 to row 9. However, with each row fired as soon as its data is loaded, the PEC needs to align with Udon's row firing sequence.

Udon's normal operating steps are described as follows:

1. Program registers to control the firing sequence and parameters.
2. Load data into the registers for a single row of the printhead.
3. Send a fire command, which latches the loaded data in the corresponding nozzles, and begins a fire sequence.
4. Load data for the next row while the fire sequence is in progress.
5. Repeat for all rows in the line.
6. Repeat for all lines on the page.

Temperature Controlled Profile Generator (TCPG) Regions

Ink viscosity is dependent on the ink temperature. Changes in the viscosity can alter the drop ejection characteristics of a nozzle. Along the length of a pagewidth printhead, the temperature may vary significantly. These variations in temperature and therefore drop ejection characteristics leave artefacts in the print. To compensate for temperature variations, each Udon printhead IC has a series of temperature sensors which output to the on-chip drive logic. This allows the drive pulse to be conditioned in accordance with the current ink temperature at that point along the printhead and thereby eliminate large differences in drop ejection characteristics.

Figure 10:
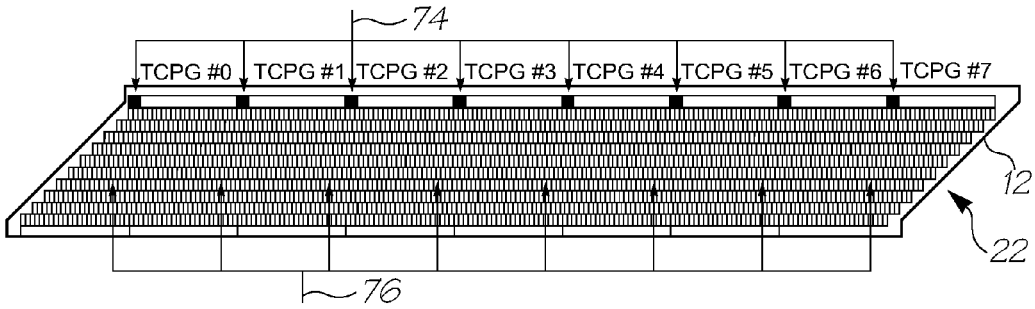
FIG. 10 shows a sketch of the eight TCPG regions across an Udon IC.

Referring to FIG. 10, each Udon IC 12 has eight temperature sensors 74 positioned along the array 22. Each sensor 74 senses the temperature in the adjacent region of nozzles, referred to as Temperature Controlled Profile Generator regions, or TCPG regions 76. A TCPG region 76 is a 'vertical' band down the IC 12 that shares temperature and firing data (see the row firing sequence described later). Pulse width is set for each color on the basis of region, and temperature within that region.

Periodic Sensor Activation

The sensors 74 allow temperature detection between 0° C. and 70° C. with a typical accuracy after calibration of 2° C. Individual temperature sensors may be switched off and a region may use the temperature sensor 74 of an adjoining region 78. This will save power with minimal effect on the correct conditioning of the drive pulse as the sensors will sense heat generated in regions outside their own because of conduction. If the steady state operating temperatures shown little or no variation along the IC, then it may be appropriate to turn off all the sensors except one, or indeed turn off all the sensors and not use any temperature compensation. Reducing the number of sensors operating at once not only reduces power consumption, but reduces the noise in other circuits in the IC.

Temperature Categories

Each TCPG region 76 has separate registers for each of the five inks. The temperature of the ink is categorised into four temperature ranges defined by three predetermined temperature thresholds. These thresholds are provided by the PEC. The profile generator within the Udon logic adjust the profile of the drive pulse to suit the current temperature category.

Sub-Ejection Pulses

Heat dissipates into the ink as the heater temperature rises to the bubble nucleation temperature. Because of this, the temperature of the ink in a nozzle will depend on how frequently it is being fired at that stage of the print job. A pagewidth printhead has a large array of nozzles and at any given time during the print job, a portion of the nozzles will not be ejecting ink. Heat dissipates into regions of the chip surrounding nozzles that are firing, increasing the temperature of those regions relative to that of non-firing regions. As a result, the ink in non-ejecting nozzles will be cooler than that in nozzles firing a series of drops. The Udon IC 12 can send non-firing nozzles 'sub-ejection' pulses during periods of inactivity to keep the ink temperature the same as that of the nozzles that are being fired frequently. A sub-ejection pulse is not enough to eject a drop of ink, but heat dissipates into ink. The amount of heat is approximately the same as the heat that conducts into the ink prior to bubble nucleation in the firing nozzles. As a result, the temperature in all the nozzles is kept relatively uniform. This helps to keep viscosity and drop ejection characteristics constant. The sub-ejection pulse reduces its energy by shortening its duration.

Drive Pulse Profiling

Actively changing the profile of the drive pulse offers many benefits including:

- optimum firing pulse for varying inks and temperatures
- warming a region before it fires
- shutting down or just slowing down an IC that gets too hot (Udon provides the information, PEC controls speed)
- adjusting for voltage drop caused by distance (extra resistance) from the power source
- reducing the energy input to the chip, as warm ink requires less energy to eject than cold ink The pulse profile can vary according to temperature and ink type. The firing pulses generated by the TCPG regions are stored in large registers that contain values for each of five inks in each of four temperature ranges, plus universal ink and region values, and threshold values. These values must be supplied to the Udon and may be stored in and/or delivered by the QA chip on the ink cartridge (see RRC001US incorporated herein by reference), the PEC, or elsewhere.

Controlling the Pulse Width

It is convenient to adjust the firing pulses by varying the pulse duration instead of voltage or current. The voltage is externally applied. Varying the current would involve resistive losses. In contrast, the pulse timing is completely programmable.

Ideal ink ejection firing pulses for Udon are typically between 0.4 s and 1.4 s. Sub-ejection firing pulses are usually less than 0.3 s. More generally, the firing pulse is a function of several factors:

- MEMs characteristics
- Ink characteristics
- Temperature
- FET type

The magnitude of the optimum firing pulse may vary depending on color and temperature. Udon stores the ejection pulse time for each color, in all temperature zones, in all regions.

Row Firing Sequence

If all nozzles in a row were fired simultaneously, the sudden increase in the current drawn would be too high for the printhead IC and supporting circuitry. To avoid this, the nozzles, or groups of nozzles, can be fired in staggered intervals. However, firing adjacent nozzles simultaneously, or even consecutively, can lead to drop misdirection. Firstly the droplet stalks (the thin column of ink connecting an ejected ink drop to the ink in the nozzle immediately prior to droplet separation) can cause micro flooding on the surface of the nozzle plate. The micro floods can partially occlude an adjacent nozzle and draw an ejected drop away from its intended trajectory. Secondly, the aerodynamic turbulence created by one ejected drop can influence the trajectory of a drop ejected simultaneously (or immediately after) from a neighboring nozzle. The second fired drop can be drawn into the slipstream of the first and thereby misdirected. Thirdly the fluidic cross talk between neighboring nozzles can cause drop misdirection.

Udon addresses this by dispersing the group of nozzles that fire simultaneously, and then fires nozzles from every subsequent dispersed group such that sequentially fired nozzles are spaced from each other. The nozzle firing sequence continues in this manner until all the nozzles (that are loaded with print data) in the row have fired.

To do this, each row of nozzles is divided into a number of adjacent spans and one nozzle from each span fires simultaneously. The subsequently firing nozzle from each span is spaced from the previously firing nozzle by a shift value. The shift value can not be a factor of the span number (that is, the shift and the span should be mutually prime) so nozzles at the boundary between neighbouring spans do not fired simultaneously, or consecutively.

Span

Figure 11:
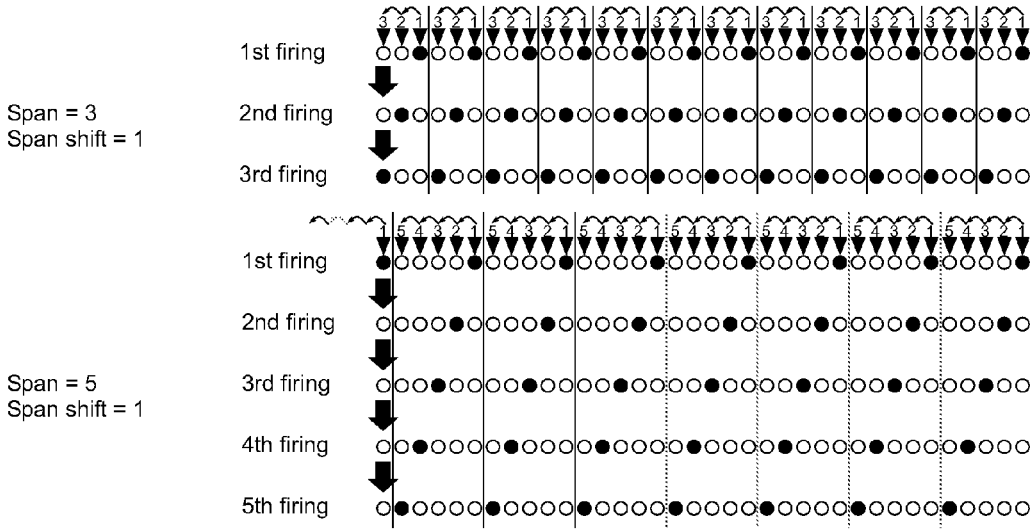
FIG. 11 is a sketch of the two nozzle rows firing in sequences defined by different span and shifts.

The span is the number of consecutive nozzles in the row from which only one nozzle will fire at a time. FIG. 11 shows a partial row of nozzles being fired with a span of three, and the same row segment with a span of five. For the purposes of illustration, the shift value is one. However, as discussed above, this is not an appropriate shift value in practice as the adjacent nozzles will fire consecutively. The turbulent wake from the drop fired from the first nozzle can interfere with the drop fired from the adjacent model immediately afterwards. It can also be a problem for the ink supply flow to the adjacent nozzles.

For a span of three, there are three firings before the entire row is fired.

First firing: every third nozzle in a row fires.

Second firing: the nozzle to one side of the first nozzle fires.

Third firing: the nozzle two across from the first nozzle fires—all nozzles on this row have now fired.

The nozzles in row N+2 now begin their fire cycle using the same span pattern.

One third of a row's nozzles fire at any one time.

For a span of five, there are five firings before the entire row is fired and one fifth of the row's nozzles fire at any one time.

At the extremes (for Udon printhead IC's):

span=1 fires all nozzles in a row simultaneously, draws too much current and will damage the IC;

span=640 fires one nozzle at a time, but may take too long to complete in the time allotted to a single row.

In any case, span only controls the maximum number of nozzles that are able to fire at any one time. Each individual nozzle still needs a 1 in its shift register to actually fire. In the examples below, we assume that the IC is printing a solid color line, so every nozzle of the color will fire. In reality, this is rarely the case.

Shift

Figure 12:
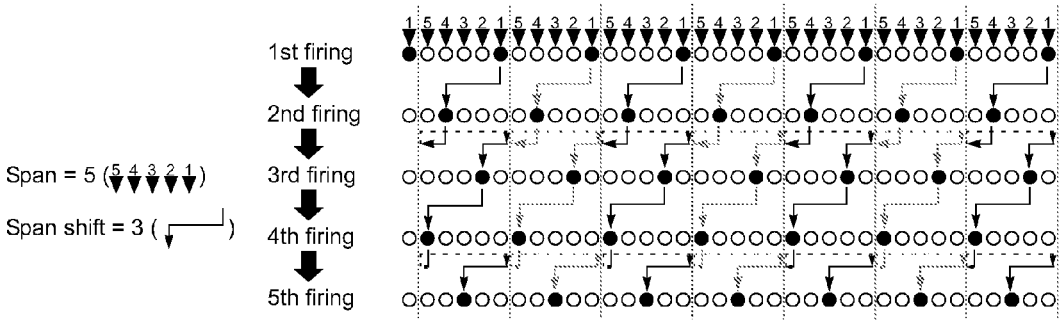
FIG. 12 is a schematic representation of the firing sequence of a nozzle row segment with a span of five and a shift of three.

The examples shown in FIG. 11 have a shift value of one. That is, one nozzle fires, then the next nozzle left fires, then the next, etc. As discussed above, this is impractical. FIG. 12 shows a segment of the nozzle row with a span of 5 with a span shift of 3.

First firing: column 1 fires.

Second firing: the firing nozzle is 3 nozzles across at column 4.

Third firing: the count has wrapped around and is back at nozzle 2.

Fourth firing: nozzle 5 fires.

Fifth firing: nozzle 3 fires—all 5 nozzles in the span have now fired.

To fire every nozzle in the row exactly once, the shift can not be a factor of the span, i.e. the span can not be divided by the shift (without remainder). To maximize droplet separation in time and space and still fire every nozzle exactly once per row, the closest mutual prime to the square root of the span should be chosen for span shift. For example, for a span of 27, a span shift of 5 would be appropriate.

Firing Delay

Firing all the nozzles in a row simultaneously, will draw a large amount of current that remains (approximately) constant for the duration of the row time. This still requires the power supply to step from zero current to a maximum current in a very short time. This creates a high rate of change of current drawn until the maximum value is reached. Unfortunately, a rapid increase in the current creates inductance which increases the circuit impedance. With high impedance, the drive voltage 'sags' until the inductance returns to normal, i.e. the current stops increasing. In printhead IC's, it is necessary to keep the actuator supply voltage within a narrow range to maintain consistent ink drop size and directionality.

Figure 13A:
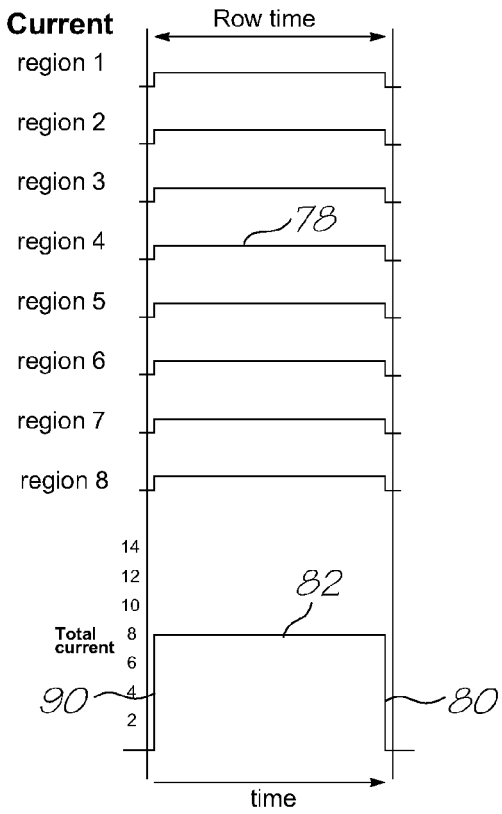
FIG. 13A the current drawn over one row time for each TCPG region and the total row during a uniformly initiated region firing sequence.
Figure 13B:
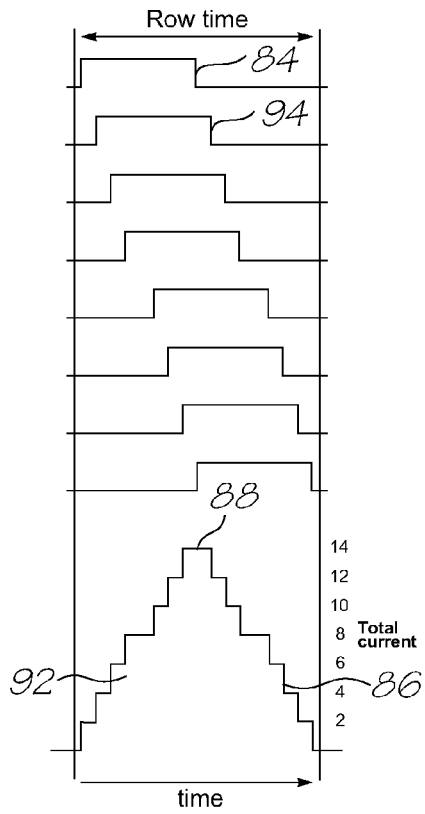
FIG. 13B is the current drawn over one row time for each TCPG region and the total row during a delayed region firing sequence.

As the firing pulses in each region can be varied by the TCPG, it can be used to delay the start of firing in each region across the printhead. This reduces the rate of change in current during firing. FIGS. 13A and 13B show the relationship between region firing delay and current drain. FIG. 13A shows the two extremes of power usage when printing a solid line of a color (this is the worst case for power supply because 80 dots will fire across the region).

FIG. 13A shows no firing delay between regions. Each region has 4 spans of 20 nozzles each. Each of the regions fire for the entire row time (row time is the time available for a complete row of nozzles to fire). Therefore, at any time during the row time, four nozzles from all of the eight regions are firing (drawing current). Hence the profile of the supply current is a long flat step function 78 and identical for each region. The profile for the entire row is the accumulated step function 80 of the individual profiles 78. Theoretically the leading edge 90 of step function 80 is vertical but in fact it is very steep until it reaches the maximum current level 82. The high rate of change in the current can cause the undesirable voltage sags.

FIG. 13B shows the current supply profiles when the regions are fired in stages. To stagger the firing of each region, the time in which the nozzles in each span can fire must be reduced. In the example shown in FIG. 13B, each span has half the row time in which to fire its nozzles. To compress the time needed for each span to fire, the number of nozzles in the span can be reduced. For example, the span in FIG. 13B is 10, so 8 nozzles (10×8=80 nozzles/region) from each span will fire simultaneously. The cumulative current drawn for eight nozzles is greater than that for the four nozzles firing per span shown in FIG. 13A. So the current drawn for each region in FIG. 13B is twice that of the regions in FIG. 13A, but the current is drawn for half the time. Region 1 is supply with current 84 at the beginning of the row time. The current supply 94 to region 2 starts after a set delay period and region 3 is similarly delayed relative to region 2, and so on until region 8 starts its firing sequence. The delays for each region need to be timed so that region 8 starts firing at or before half the row time has elapsed.

The cumulative current supply profile 86 shows the series of 8 rapid steps in the current supply as it reaches its maximum value 88. The maximum current 88 is greater than the maximum current 82 in the non-delayed region firing, but the rate of increase in the supply current 92 is less. This induces less impedance in the circuit so that the voltage sag is lower. In each case, the total energy used is the same for a given row time but the distribution of energy consumption is adjusted.

Normal Firing Order

As discussed above, print data is sent to the printhead IC's 12 one row at a time followed by a fire command. Previously, each individual unit cell in the nozzle array had a shift register to store the print data (a '1' or '0') for each nozzle, for each line time (the line time is the time taken for the printhead to print one line of print). The print data for the entire array would be loaded into the shift registers before a fire command initiated the firing sequence. By loading and firing the print data for each line in stages, a smaller number of shift registers can be positioned adjacent the array instead of within each unit cell. Removing the shift registers from the unit cell 20 allows the drive FET 40 (see FIG. 2) to be larger. This improves the printhead efficiency for the reasons set out below.

Thermal printhead IC's are more efficient if the vapor bubble generated by heater element is nucleated quickly. Less heat dissipates into the ink prior to bubble nucleation. Faster nucleation of the bubble reduces the time that heat can diffuse into wafer regions surrounding the heater. To get the bubble to nucleate more quickly, the electrical pulse needs to have a shorter duration while still providing the same energy to the heater (about 200 nJ). This requires the drive FET for each nozzle to increase the power of the drive pulse. However, increasing the power of the drive FET increases its size. This enlarges the wafer area occupied by the nozzle and its associated circuitry and therefore reduces the nozzle density of the printhead. Reducing the nozzle density is detrimental to print quality and compact printhead design. By removing the shift register from the unit cell, the drive FET can be more powerful without compromising nozzle density.

The Udon design writes data to the nozzle array one row at a time. However, a printhead IC that loaded and fired several rows at a time would also be achieving the similar benefits. However, it should be noted that the electrical connection between the shift register and the corresponding nozzle should be kept relatively short so as not to cause high resistive losses.

Loading and firing the print data one row at a time requires the PEC to send the data in the row order that it is printed. Previously the data for the entire nozzle array was loaded before firing so the PEC was indifferent to the row firing order chosen by the printhead IC. With Udon, the PEC will need to transmit row data in a predetermined order.

Printhead nozzles are normally fired according to the span/shift fire sequence and the delayed region start discussed above. The supply channels 50 in the back of the printhead IC 12 (see FIG. 5C) supply ink to two adjacent rows of nozzle on the front of the IC, that is rows 0 and 1 eject the same color, rows 2 and 3 eject another color, and so on. The Udon printhead IC has ten row of nozzles, these can be designated colors CMYK, IR (infra-red ink for encoding the media with data invisible to the eye) or CMYKK. To avoid ink supply flow problems, every second row is fired in two passes, that is row 0, row 2, row 4, row 6, row 8, then row 1, row 3, row 5, and so on until all ten row are fired.

Row firings should be timed such that each row takes just under 10% of the total line time to fire. A fire command simply fires the data that is currently loaded. When operating in SoPEC mode, Udon printhead IC receives a 'data next' command that loads the next row of data in the predetermined order. In MoPEC mode, each row of data must be specifically addressed to its row.

Taking paper movement into account, a row time of just less than 0.1 line time, together with the 10.1DP (dot pitch) vertical color pitch appears on paper as a 10DP line separation. Odd and even same-color rows of nozzles, spaced 3.5DP apart vertically and fired 0.5 line time apart results as dots on paper 5DP apart vertically.

Fire Cycle

Figure 14:
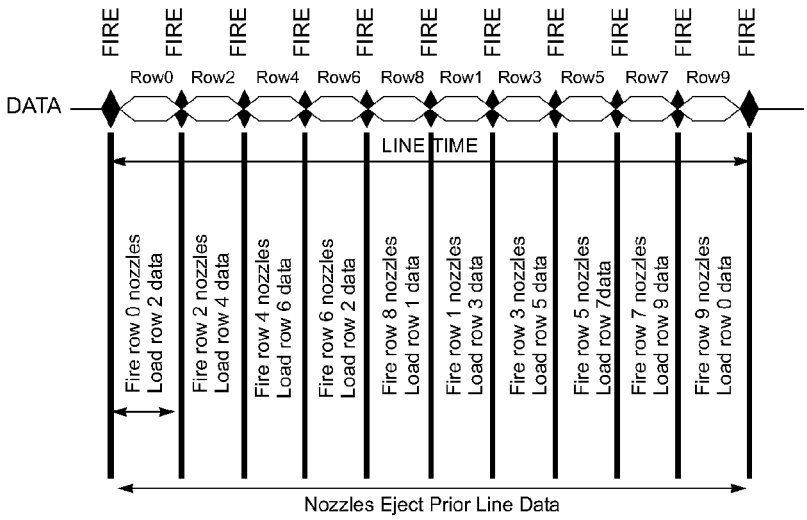
FIG. 14 is the dot data loading and row firing sequence for a ten row Udon IC.

FIG. 14 shows the data flows and fire command sequences for a line of data. When a fire command is received in the data stream, the data in the row of shift registers transfers to a dot-latch in each of the unit cells, and a fire cycle is started to eject ink from every nozzle that has a 1 in its dot-latch. Meanwhile the data for the next row in the firing order is loaded.

Drop Triangle and Droop Section Firing Delay

Figure 15:
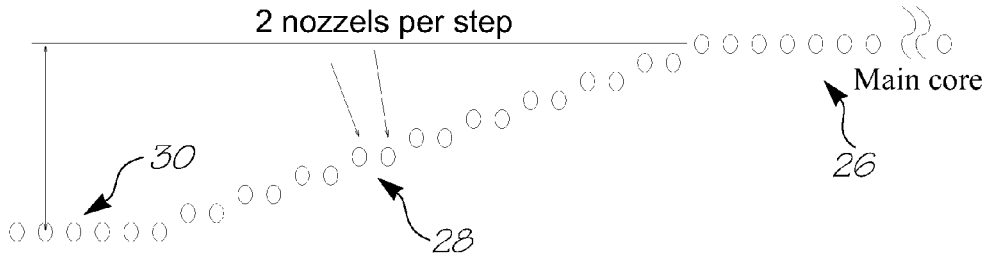
FIG. 15 shows the drop triangle and sloping segment of a nozzle row together with the relevant printing delay for the dot data at the 'dropped' nozzles.

Drop compensation is the compensation applied by Udon drive logic 46 (see FIG. 2) to the sloping region 28 and drop triangle 30 of nozzles at the left of the nozzle array 22 on each IC 12 (see FIG. 5C). As shown in FIG. 15, the print data to the nozzles that are displaced from the rest of the array 22 needs to be delayed by a certain number of line times. FIG. 15 shows the nozzles in one row 26 of the IC 12. The nozzles in the drop triangle 30 are all displaced 10 dot pitches from the non-displaced nozzles in the row. The nozzles in the droop section 28 that connects the drop triangle 30 and the non-displaced nozzles have a displacement that indexes by one dot pitch every two nozzles. In the sloping droop region 28 the drive logic indexes the delay in firing the dot data correspondingly.

Nozzle Blockage Clearing

During periods of inactivity, or even between pages, and especially at higher ambient temperatures, nozzles may become blocked with more viscous or dried ink. Water can evaporate from the ink in the nozzles thereby increasing the viscosity of the ink to the point where the bubble is unable to eject the drop. The nozzle becomes clogged and inoperable.

Many printers have a printhead maintenance regime that can recover clogged nozzles and clean the exterior face of the printhead. These create a vacuum to suck the ink through the nozzle so that the less viscous ink refills the nozzle. A relatively large volume of ink is wasted by this process requiring the cartridges to be replaced more frequently.

Udon printhead IC's have a maintenance mode that can operate before or during a print job. During maintenance mode the drive logic generates a de-clog pulse for the actuators in each nozzle unless the dead nozzle map (described below) indicates that the actuator has failed. To operate during a print job, the nozzles should fire the de-clog pulse into the gap between pages without interruption to the paper.

The de-clog pulse is longer than the normal drive pulses. The bubble formed from a longer duration pulse is larger and imparts a greater impulse to the ink than a firing impulse. This gives the pulse the additional force that may be needed to eject high viscosity ink.

Figure 16:
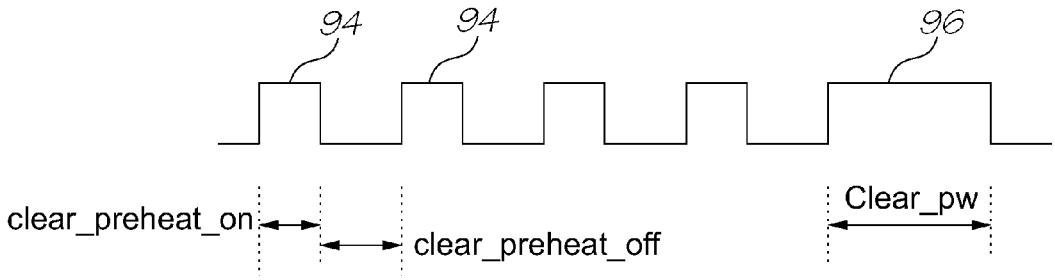
FIG. 16 shows de-clog pulse train.

As a preliminary measure, the de-clog pulse can be preceded by a series of sub-ejection pulses to warm the ink and lower viscosity. FIG. 16 shows a typical de-clog pulse train with a series of short (relative to a firing pulse) sub-ejection pulses 94 followed by a single de-clog pulse 96. The individual sub-ejection pulses 94 have insufficient energy to nucleate a bubble and therefore eject ink. However, a rapid series of them raises the ink temperature to assist the subsequent de-clog pulse 96.

Open Actuator Testing

The Udon printhead IC 12 supports an open actuator test. The open actuator test (OAT) is used to discover whether any actuators in the nozzles array have burnt out and fractured (usually referred to as becoming 'open' or 'open circuit').

Fabrication of the MEMS nozzle structures on wafer substrates will invariably result in some defective nozzles. These 'dead nozzles' can be located using a wafer probe immediately after fabrication. Knowing the location of the dead nozzles, the print engine controller (PEC) can be programmed with a dead nozzle map. This is used to compensate for the dead nozzles with techniques such as nozzle redundancy (the printhead IC is has more nozzles than necessary and uses the 'spare' nozzles to print the dots normally assigned to the dead nozzles).

Unfortunately, nozzles also fail during the operational life of the printhead. It is not possible to locate these nozzles using a wafer probe once they have been mounted to the printhead assembly and installed in the printer. Over time, the number of dead nozzles increases and as the PEC is not aware of them, there is no attempt to compensate for them. This eventually causes visible artifacts that are detrimental to the print quality.

In thermal inkjet printheads and thermal bend inkjet printheads, the vast majority of failures are the result of the resistive heater burning out or going open circuit. Nozzles may fail to eject ink because of clogging but this is not a 'dead nozzle' and may be recovered through the printer maintenance regime. By determining which nozzles are dead with an on-chip test, the print engine controller can periodically update its dead nozzle map. With an accurate dead nozzles map, the PEC can use compensation techniques (e.g. nozzle redundancy) to extend the operational life of the printhead.

The Udon IC open actuator test compares the resistance of the actuator to a predetermined threshold. A high (or infinite) resistance indicates that the actuator has failed and this information is fed back to the PEC to update its dead nozzle compensation tables. It is important to note that the OAT can discover open circuit nozzles, but not clogged nozzles.

Figure 17A:
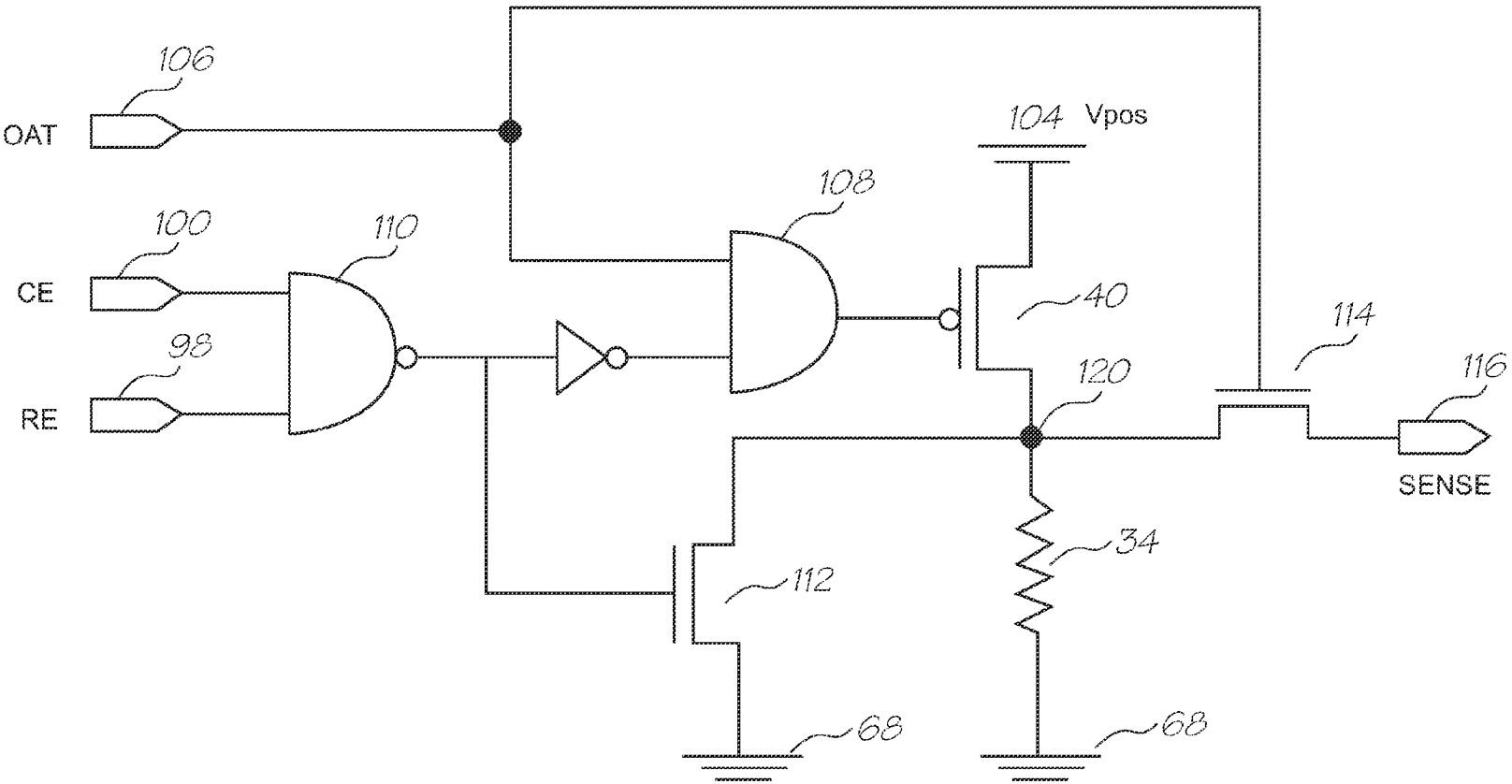
FIG. 17A is the circuitry for the Open Actuator Test in a unit cell with p-type drive FET; and, FIG. 17B is the circuitry for the Open Actuator Test in a unit cell with n-type drive FET.
Figure 17B:
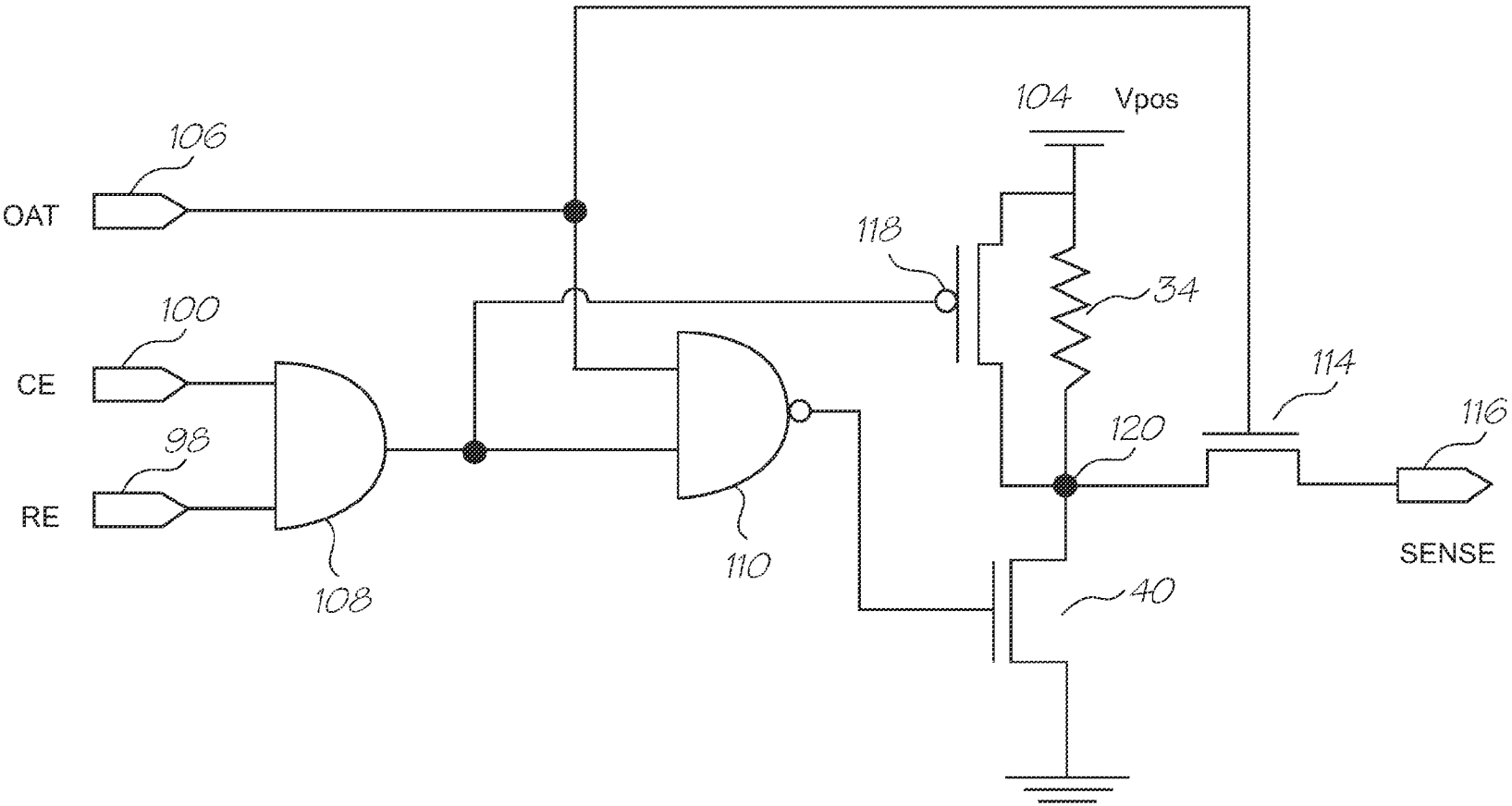

Thermal actuators and thermal bend actuator both use heater elements and the OAT can be equally applied to either. Likewise, the drive FET can be N-type or P-type. FIGS. 17A and 17B show the circuits for the OAT as applied to a single unit cell with a single heater element driven by a p-FET and an n-FET respectively.

In FIG. 17A, the drive p-FET 40 is enabled during printing whenever the 'row enable' (RE) 98 and 'column enable' (CE) 100 are both asserted (receive '1's at their contacts). Enabling the drive FET 40 opens the heater element 34 to Vpos 104 to activate the unit cell. When the row enable 98 or the column enable 100 are not asserted, the bleed n-FET is enabled. The bleed n-FET 112 ensures that the voltage at the sense node 120 is pulled low when the unit cell is not activated to eliminate any electrolysis path.

When the OAT 106 is asserted, the AND gate 108 pulls the gate of the drive p-FET 40 high to disable it. Asserting the OAT 106 also pulls the gate of the sense n-FET 114 high to connect the sense output 116 to the sense node 120. With the bleed n-FET 112 disabled the voltage at the sense node 120 will still be pulled low through the heater element 34 to ground 68. Accordingly, the sense output 116 is low to indicate that the actuator is still operational. However, if the heater element 34 is open (failed), the voltage at the sense node 120 remains high and this pulls the sense output 116 high to indicate a dead nozzle. This is fed back to the PEC which updates the dead nozzle map and initiates measures to compensate (if possible). The unit cell circuitry shown in FIG. 17B uses a drive n-FET 40. In this embodiment, asserting the row enable 98 and the column enable 100 pulls the gate of the drive n-FET 40 high to enable it and allow Vpos 104 to drain to ground through the heater 34. Again the bleed p-FET 118 is disabled whenever the row enable 98 and column enable 100 are asserted.

To initiate an actuator test, the OAT 106 is asserted, together with the row enable 98 and column enable 100. This disables the drive n-FET 40 by pulling the gate low using NAND logic 110. It also opens the sense n-FET 114 to connect the sense output 116 to the sense node 120. With the heater 34 insulated from ground 68 when the drive FET 40 is disabled, the sense node 120 is pulled high and a high sense output 116 indicates a working actuator. If the heater 34 is broken, the sense node 120 is left at low voltage following the last time the drive FET 40 was enabled. Accordingly when the OAT is enabled, the sense output 116 is low and the PEC records the dead nozzle to the dead nozzle map.

It will be appreciated that the open actuator test should be performed shortly after the printhead IC has been printing. After a period of inactivity, the bleed p-FET 118 or n-FET 112 drops the sense node to low voltage. The gap in printing between pages is a convenient opportunity to perform an open actuator test.

The present invention has been described herein by way of example only. Skilled workers in this field will readily recognise many variations and modification which do not depart from the spirit and scope of the broad inventive concept.

We claim:

1. An inkjet printer comprising:

a printhead IC having:

an array of nozzles for ejecting drops of printing fluid onto a media substrate; and, drive circuitry for driving the array of nozzles; and, a print engine controller (PEC) for sending print data to the printhead IC; wherein, the drive circuitry is configured to extract a clock signal from the data transmission from the PEC.

2. An inkjet printer according to claim 1 wherein the data transmission is a digital signal that has a rising edge at every clock period.

3. An inkjet printer according to claim 2 wherein the drive circuitry determines a data bit from every clock period by the position of the falling edge during that period.

4. An inkjet printer according to claim 3 linked with other like printhead IC's to form a pagewidth printhead, wherein the data transmission is multi-dropped to all the printhead IC's and each printhead IC has a unique write address provided by the PEC.

5. An inkjet printer according to claim 4 wherein the interface between the printhead and the PEC has only two connections.

6. An inkjet printhead according to claim 1 further comprising a plurality of temperature sensors positioned along the array of nozzles such that the drive circuitry adjusts the drive pulses in response to the temperature sensor outputs.

7. An inkjet printhead according to claim 6 wherein each of the plurality of temperature sensors is activated sequentially for a period of time during the print job.

8. An inkjet printhead according to claim 6 wherein the plurality of temperatures sensors are divided into two or more groups, each group being activated for a sensing period in accordance with a predetermined repeating sequence for the duration of a print job.

9. An inkjet printhead according to claim 8 wherein every second temperature sensor in the plurality of temperature sensors is de-activated such that the drive circuitry adjusts the drive pulse profile for the region corresponding to each activated temperature sensor and applies the same adjustment to the adjacent region where the temperature sensor is de-activated.

10. An inkjet printhead according to claim 6 wherein each of the plurality of temperature sensors, is configured to sense the temperature a corresponding region of the array such that the drive pulse for the nozzles in one region can differs from the drive pulse for the nozzles in another region.

11. An inkjet printhead according to claim 1 wherein the drive circuitry is programmed with a series of temperature thresholds defining a set of temperature zones, each of the zones having a different pulse profile for the drive pulses sent to the nozzles in the region currently operating in that temperature zone.

12. An inkjet printhead according to claim 11 wherein the pulse profile for each temperature zone differs in its duration.

13. An inkjet printhead according to claim 12 wherein the drive circuitry sets the pulse duration to zero if the temperature sensor indicates that region is operating at a temperature above the highest of the temperature thresholds.

14. An inkjet printhead according to claim 1 wherein the drive circuitry sets the duration of the pulse profile to a sub ejection value for any of the nozzles in the row that are not to eject a drop during that firing sequence.

15. An inkjet printhead according to claim 1 mounted to a pagewidth printhead with a plurality of like printhead IC's, wherein all the printhead IC's have a common initial address with one exception, the exception having a different address such that the print engine controller sends a first instruction to any printhead IC's having the different address, the first broadcast instruction instructing the printhead IC having the different address to change its address to a first unique address, the printhead IC's being connected to each other such that once the exception has changed its address to the first unique address, it causes one of the printhead IC's having a common address to change its address to the different address, so that when the print engine controller sends a second broadcast instruction to the different address, the printhead IC with the different address changes its address to a second unique address as well as causing one of the remaining printhead IC's having the common address to change to a different address, the process repeating until the print engine controller assigns the printhead IC's with mutually unique addresses.

16. An inkjet printhead according to claim 15 wherein during use feedback from the open actuator test circuitry is used to adjust the print data subsequently received by the drive circuitry.

17. An inkjet printhead according to claim 1 further comprising open actuator test circuitry for selectively disabling the actuators when they receive a drive signal while comparing the resistance of the resistive heater to a predetermined threshold to assess whether the actuator is defective.

18. An inkjet printhead according to claim 1 wherein the drive circuitry is configured to operate in two modes, a printing mode in which the drive pulses it generates are printing pulses, and a maintenance mode in which the drive pulses are de-clog pulses, such that, the de-clog pulse has a longer duration than the printing pulse.

19. An inkjet printhead according to claim 1 wherein the drive circuitry resets itself to a known initial state in response to receiving power from a power source after a period of not receiving power from the power source.

20. An inkjet printhead according to claim 1 wherein the drive circuitry is configured to receive the print data in any one of a plurality of different data transmission protocols.

* * * * *